US010653238B1

(12) United States Patent
Bucci

(10) Patent No.: US 10,653,238 B1
(45) Date of Patent: May 19, 2020

(54) PORTABLE, COLLAPSIBLE, FREE-STANDING BAR

(71) Applicant: Douglas Fergus Bucci, Rockville, MD (US)

(72) Inventor: Douglas Fergus Bucci, Rockville, MD (US)

( * ) Notice: Subject to any disclaimer, the term of this patent is extended or adjusted under 35 U.S.C. 154(b) by 0 days.

(21) Appl. No.: 16/392,490

(22) Filed: Apr. 23, 2019

Related U.S. Application Data

(60) Provisional application No. 62/762,336, filed on May 1, 2018.

(51) Int. Cl.

| | |
|---|---|
| ***A47B 31/04*** | (2006.01) |
| ***A47B 13/08*** | (2006.01) |
| ***A47B 13/04*** | (2006.01) |
| ***A47B 91/02*** | (2006.01) |
| ***A47B 3/12*** | (2006.01) |

(52) U.S. Cl.
CPC ..... *A47B 31/04* (2013.01); *A47B 3/12* (2013.01); *A47B 13/04* (2013.01); *A47B 13/088* (2013.01); *A47B 91/022* (2013.01)

(58) Field of Classification Search
CPC .... A47B 3/00; A47B 3/10; A47B 3/12; A47B 31/04; A47B 2031/008; A47B 2031/004; A47B 43/00
USPC ..... 108/115, 165, 162, 173, 175, 124, 128, 108/35; 312/258, 140.2
See application file for complete search history.

(56) References Cited

U.S. PATENT DOCUMENTS

| | | | | | |
|---|---|---|---|---|---|
| 490,320 | A * | 1/1893 | Smyth | 108/124 | |
| 2,004,296 | A * | 6/1935 | Royce | A47B 1/04 312/282 | |
| 2,808,305 | A * | 10/1957 | Jackson | A47B 43/00 312/140.2 | |
| 3,033,632 | A * | 5/1962 | Major | A47B 43/00 312/140.2 | |

(Continued)

*Primary Examiner* — Jose V Chen

(57) ABSTRACT

"The Portable, Collapsible, Free-Standing Bar" is an improved portable and compact free-standing bar. Its distinctive features include its ease of assembly, stability, well-crafted finished-wood appearance, collapsible design, compact storage, and ease of transport and shipping. It can be assembled easily without tools, and is designed meticulously to minimize weight, maximize stability and portability, and minimize the space that it occupies when collapsed and stored. These user-friendly features make the bar a useful contribution to an improved social experience in many venues, including weddings, tailgate parties, etc. The bar design is comprised of a bartop formed by a plurality of selectively adjoining bartop pieces and a plurality of frames pivotally interlocked by at least one hinge, which allow the bar to be collapsed into a space-efficient unit on wheels for storage, transport, or shipping. The bar can be alternately be assembled in an open position for using the bar and disassembled to a closed position for transporting or storing the bar, wherein in the closed position the bartop pieces are nested within the frames, and wherein said frames are collapsed to a compact folded configuration forming a parallelepiped. Another aspect of the bar's design is a swivel footing rotatably attached to a base support of each frame that adds significant stability to the bar when in the open position without adding to the width, or overall size of the collapsed bar is the closed position.

16 Claims, 27 Drawing Sheets

(56) References Cited

U.S. PATENT DOCUMENTS

| | | | | | |
|---|---|---|---|---|---|
| 3,140,133 | A * | 7/1964 | Kraft | A47B 69/00 | 312/140.2 |
| 3,436,092 | A * | 4/1969 | Udo | A47B 31/04 | 280/651 |
| 3,841,728 | A * | 10/1974 | Petersen | A47B 43/00 | 312/140.2 |
| D306,664 | S * | 3/1990 | Pouch | 312/140.2 | |
| 5,382,087 | A * | 1/1995 | Pouch | A47B 43/00 | 160/135 |
| D417,981 | S * | 12/1999 | Zwicker | D6/699.1 | |
| 6,095,056 | A * | 8/2000 | Schumacher | A63B 71/0054 | 108/115 |
| 6,918,640 | B2 * | 7/2005 | DeMars | A47B 77/10 | 312/140.2 |
| 7,201,458 | B2 * | 4/2007 | DeMars | A47J 37/0781 | 126/25 R |
| D590,640 | S * | 4/2009 | Fearns | D6/699 | |
| 7,975,626 | B1 * | 7/2011 | Wang | A47B 3/06 | 108/115 |
| D646,508 | S * | 10/2011 | Parizek | D6/691.4 | |
| D652,655 | S * | 1/2012 | Parizek | D6/651 | |
| 8,534,779 | B2 * | 9/2013 | Schaaf | A47B 46/005 | 312/272.5 |
| D758,773 | S * | 6/2016 | Kim | D6/672 | |
| 2005/0051062 | A1 * | 3/2005 | Tetley | A47B 3/002 | 108/115 |
| 2013/0206044 | A1 * | 8/2013 | Hesselmann | A47F 9/00 | 108/179 |

* cited by examiner

PORTABLE, COLLAPSIBLE, FREE-STANDING BAR

RELATED APPLICATION

This application is a continuation application of provisional U.S. Application No. 62/762,336, entitled "Portable, Collapsible, Free-Standing Bar" which was filed on May 1, 2018.

BACKGROUND OF THE INVENTION

Field of the Invention

The present invention relates generally to the portable table-top furniture field. Tables and serving countertops have, in many cultures, long been purposed to enhance social lifestyle and engagements, to facilitate relationships and the creation of bonds between people, to enable sharing and exchange and to generally foster communication and socialization. In other words, tabletops are often the centerpieces that people gather around for social engagements. The American bar holds a major role in history. As noted, it has been used as a facilitator of communication and socialization, allowing for human connections to be established and fostered.

2. Description of Related Art

The state of the art within the portable table-top furniture field presents a number of opportunities for improvement. Products typically are bulky, heavy, and/or permanently consume significant space when not in use. Another opportunity for improvement is usability. Products commonly are difficult to assemble and require tools and considerable labor to set up and use.

The Portable, Collapsible, Free-Standing Bar is a significant improvement upon the current state of the art by virtue of several innovative features. The unique design and engineering of the bar creates an enduring, stylish product that is also quick and easy to assemble without tools. Set-up time out of the box is less than three minutes. Physical exertion for assembly or for collapse and storage is reduced because the bar is thin, light, and compact. The compact design also allows the bar to be transported or shipped cost effectively as a flat-pack, compact box ready for immediate assembly and use.

SUMMARY OF THE INVENTION

"The Portable, Collapsible, Free-Standing Bar" is an improved portable and compact free-standing bar. Its distinctive features include its ease of assembly, stability, well-crafted finished-wood appearance, collapsible design, compact storage, and ease of transport and shipping. The bar is a quality piece of tabletop furniture without the traditional big, bulky design, the complicated assembly, or the permanent space consumption. It can be assembled easily without tools, and is designed meticulously to minimize weight, maximize stability and portability, and minimize the space that it occupies when collapsed and stored. These user-friendly features make the bar a useful contribution to an improved social experience in many venues, including weddings, tailgate parties, etc.

The bar design is comprised of a bartop formed by a plurality of selectively adjoining bartop pieces and a plurality of frames pivotally interlocked by at least one hinge, which allow the bar to be collapsed into a space-efficient unit on wheels for storage, transport, or shipping. Rare-earth magnets, or other connection apparatuses, are used to ensure that the frames of the collapsed bar—which close as an accordion does—remain securely attached during storage. The unique design allows the bartop pieces to be stored within the frames of the bar, further contributing to ease of portability and storage efficiency. One way to keep the bartop pieces in place and prevent them from moving around within the collapsed frame during storage or transport is by means of a lace and a cleat, although another locking or tightening mechanism could also be used for this purpose. Another aspect of the bar's design is a swivel footing rotatably attached to a base support of each frame that adds significant stability to the bar when in the open position without adding to the width, or overall size of the collapsed bar is the closed position.

The Portable, Collapsible, Free-Standing Bar is in the Machine and Article of Manufacturing Statutory Class. The preferred material for the product—not considering aesthetics and price—is any light-weight material that provides a balance of strength and stability. Material selection should be made to produce the best weight-to-strength ratio. (In the case where aesthetics are paramount and price is not an obstacle for the consumer, a heavier, higher quality material could be used.) Additionally, a water-resistant material is necessary for the durability of the product. Consider that the materials need not be water-resistant in their original state; there are various procedures that can be employed to make materials water resistant. These procedures also tend to make the material stronger. Other factors to consider when selecting the material are manufacturing speed, material waste, utility benefit versus manufacturing ease, material cost, weight distribution, and manufacturing energy consumption. The material used for the apparatus drawings and photographs in this patent is wood.

The current diagrams display a final product with four frames organized at particular angles when in use. However, it is important to note that the product could be produced with more or fewer frames and/or with those frames' organization at different angles during use. There is a wide variety of possibilities for how to arrange the frames in relation to one another when the bar is open and in use. Additionally, the product could ultimately consist of more or fewer frames in order to adhere to a variety of desired tasks and demands.

The present invention defines a portable bar comprising: a plurality of frames 20 pivotally attached to each other by at least one hinge 22; a bartop formed by a plurality selectively interlocking bartop pieces 2, 3, 4, 5, each bartop piece corresponding with each respective frame 20; and a plurality of swivel footings 13, each footing rotatably attached to a bottom surface of a corresponding frame 20.

The bar is capable of alternately being configured in an open position (as illustrated in FIGS. 5-10) for using the bar, and a closed position (as illustrated in FIGS. 1-4) for transporting or storing the bar.

In the open position (as illustrated in FIGS. 5-10) for using the bar: each bartop piece 2, 3, 4, 5 is selectively attached to at least one other adjacent bartop piece; each bartop piece 2, 3, 4, 5 is selectively mounted to a corresponding top surface of each respective frame 2; and each footing 13 is rotated such that a length thereof is not parallel with a plane of the corresponding frame to which it is attached, in order to enhance stability.

In the closed position (as illustrated in FIGS. 1-4) for transporting or storing the bar: each bartop piece 2, 3, 4, 5 is selectively secured within a recess of each respective frame 20; the plurality of frames 20 collapse in accordion fashion to a compact folded configuration forming a parallelepiped; and each footing 13 is rotated such that a length thereof is parallel with a plane of the corresponding frame to which it is attached in order to minimize spatial requirements.

The bar includes a frame assembly that consists of a plurality of frames 20 pivotally attached to each other by at least one hinge 22, wherein each frame 20 in the apparatus will have its own corresponding bartop piece 2, 3, 4, 5, which is selectively mounted atop each respective frame 20.

Each frame 20 of the plurality of frames forming the frame assembly comprises: a horizontal support 23 connecting two vertical sidings 28 and forming an uppermost part of said frame for selectively connecting to a respective corresponding bartop piece 2, 3, 4, 5 in the open position; a base support 9 that runs horizontally connecting to the two vertical sidings 28 and forming a bottommost part of said frame 20 that attaches to a respective footing 13; a frame panel 20A matching the cross-sectional profile formed by the horizontal support, two vertical sidings, and base support, to form a front surface of the bar in the open position; and a lower horizontal support 25 above the base support 9 and extending between the two vertical sidings 28 to support a corresponding bartop piece 2, 3, 4, 5 resting thereon and stored within said frame when the bar is not in use.

Each frame 20 of the plurality of frames may further comprise: at least one storage stopper 26 extending from at least one of an inner surface of one of the vertical sidings 28 and a top surface of the lower horizontal support 25 to secure a bartop piece 2, 3, 4, 5 in the closed position; and a lace 24 attached to the lower horizontal support to selectively attach to a cleat 12 of a respective corresponding bartop piece in the closed position.

The base support 9 runs horizontally and is the bottommost part of each frame 20. This base support 9 is the part of the frame 20 that connects to a corresponding footing 13 and where a footing locking block 16 is located. The vertical sidings 28 run vertically on opposite ends of each frame 20 and are the outermost part of said frame on each side. The frame panel's 20A dimension, i.e. height and length, match an outline formed by the horizontal support 23, vertical sidings 28, and base support 9, and is attached to an outward-facing side of the frame 20 in the open position. The frame panel 20A can be left plain (to look like the material from which the apparatus is made) or it can be customized with the user's desired images or designs. The frame panel 20A could also be painted a color desired by the user.

REFERENCE NUMBERS

Figure 1:
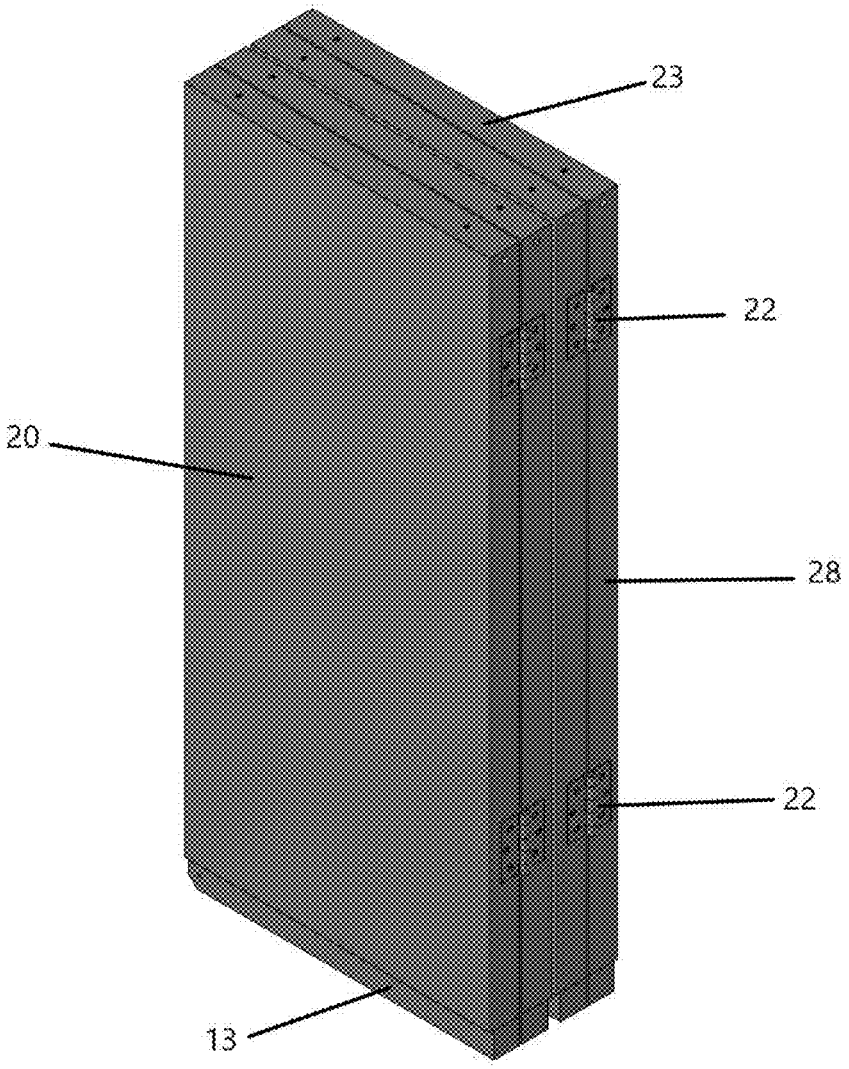
FIG. 1 is a front, top-left perspective view (from slightly above) of the frames of the frame assembly collapsed in the closed position for transit or storage.

1. Assembled Bartop
2. First Bartop Piece
3. Second Bartop Piece
4. Third Bartop Piece
5. Fourth Bartop Piece
6. Bartop Alignment Pin
7. Bartop Alignment Hole
8. Bartop Edge Routing
9. Base Support
10. Buckle Latch
11. Buckle Latch Magnets
12. Cleat
13. Footing
14. Footing Locking System
15. Footing Locking Counter-bore
16. Footing Locking Block
17. Footing Locking Knob
18. Footing Locking Dowel Rod
19. Footing Locking Dowel Head
20. Frame
20A. Frame Panel
21. Frame Locking Magnets
22. Hinges
23. Horizontal Support
24. Lace
25. Lower Horizontal Support
26. Storage Stopper
27. Underside Connector
28. Vertical Siding
29. Bottle Opener
30. Bottle Opener Counter-bore
31. Bottle Opener Plate
32. Leveler
33. Leveler Counter-bore
34. Leveler Head
35. Leveler Threaded Rod
36. Leveler Tip
37. Leveler Wrench Key
38. Leveler Wrench Magnet
39. Wheels
40. Axle
41. Threaded Inserts
42. Threaded Knob
43. Threaded Bolt
44. Threaded T-Bolt
45. T-Track
46. Washer Wingnut
47. Wood Peg

DETAILED DESCRIPTION OF THE INVENTION

FIGS. 5-6, 8-11, and 23-28 illustrate bartop pieces 2, 3, 4, 5 which selectively adjoin in the open position during use to form an assembled bartop 1. A frame assembly consists of a plurality of frames 20 pivotally attached to each other by at least one hinge 22, wherein each frame 20 in the apparatus will have its own corresponding bartop piece 2, 3, 4, 5, which is selectively mounted atop each respective frame and connects to at least one other adjacent bartop piece when the apparatus is in an open position during use. When these bartop pieces 2, 3, 4, 5 are joined together in an open position during use, a complete, cohesive assembled bartop 1 is formed. The shape of each independent bartop piece 2, 3, 4, 5 can vary, depending on the respective bartop piece's location relative to the assembled bartop 1 and the apparatus' overall design/alignment. Each bartop piece 2, 3, 4, 5 can be attached to each respective corresponding frame 20 in the open position while in operational use, but can also be stored away into its corresponding frame in a closed position when not in use (i.e. in transport or storage). In this design, as illustrated in the drawings, the frame assembly comprises four frames 20 that collapse in accordion fashion to a compact folded configuration forming a parallelepiped (as illustrated in FIGS. 1-4). It is further contemplated that the bar design may have fewer or more frames and bartop pieces to allow for a variety of configurations and shapes.

Figure 25:
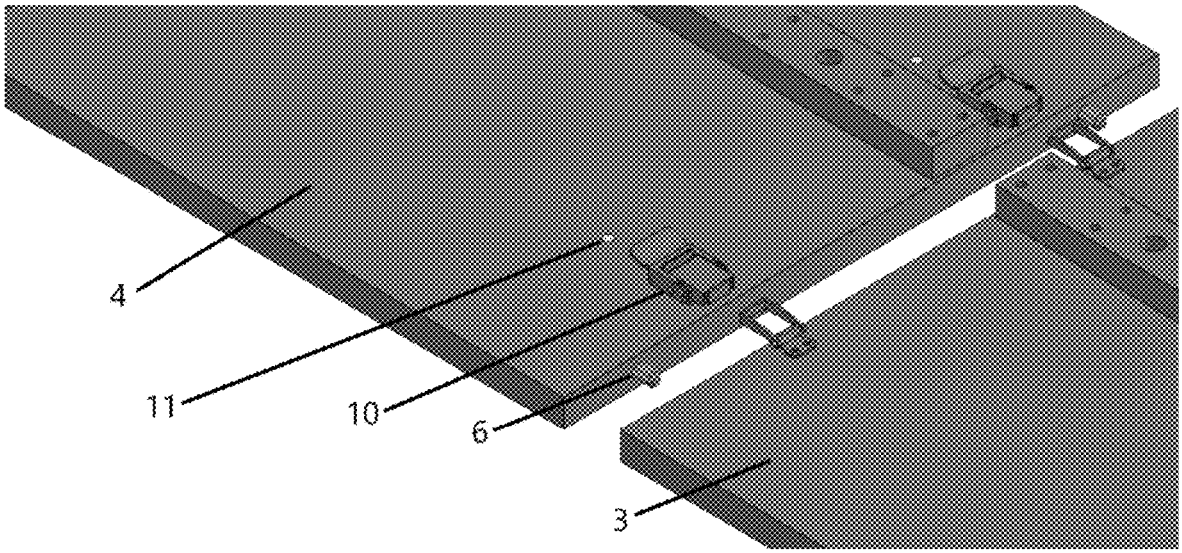
FIG. 25 is an enlarged, rear, bottom perspective view (from slightly below) of a first embodiment of the bartop pieces selectively adjoined by alignment pins received by corresponding alignment holes.
Figure 26:
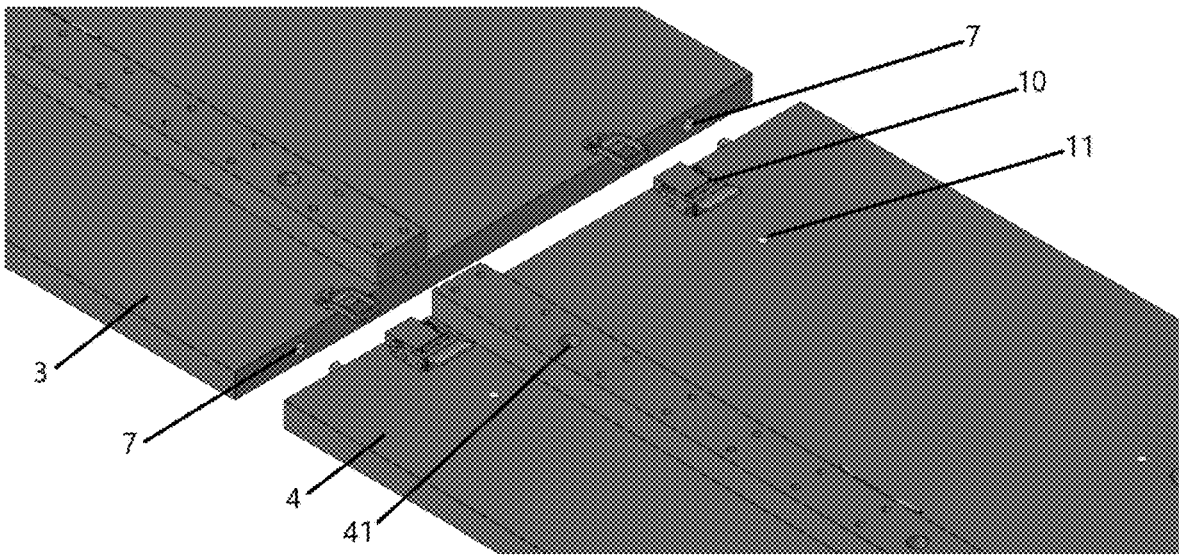
FIG. 26 is an enlarged, front, bottom perspective view (from slightly below) of the first embodiment of the bartop pieces in FIG. 25.

FIGS. 25-26 illustrate a first embodiment of the bartop wherein adjacent bartop pieces 2, 3, 4, 5 are selectively interlocked in the open position by inserting bartop alignment pins 6 of one bartop piece into corresponding bartop alignment pin holes 7 of another adjacent bartop piece to form a stable and secure assembled bartop 1 in the open position during use. The bartop alignment pins 6 will serve the purpose of interlocking adjacent bartop pieces—and, thus, also further securing frames together—to provide more stability in the assembled bartop 1, as well as in the overall bar, when in use. Alignment pins 6 are located on an edge of at least one bartop piece (e.g. bartop piece 4) that fit snugly into corresponding alignment pin holes 7 of at least one other adjacent bartop piece (e.g. bartop piece 3). The cooperative alignment pin/hole configuration assists in minimizing movement and shifting of the assembled bartop 1 in the open configuration when in use.

Figure 27:
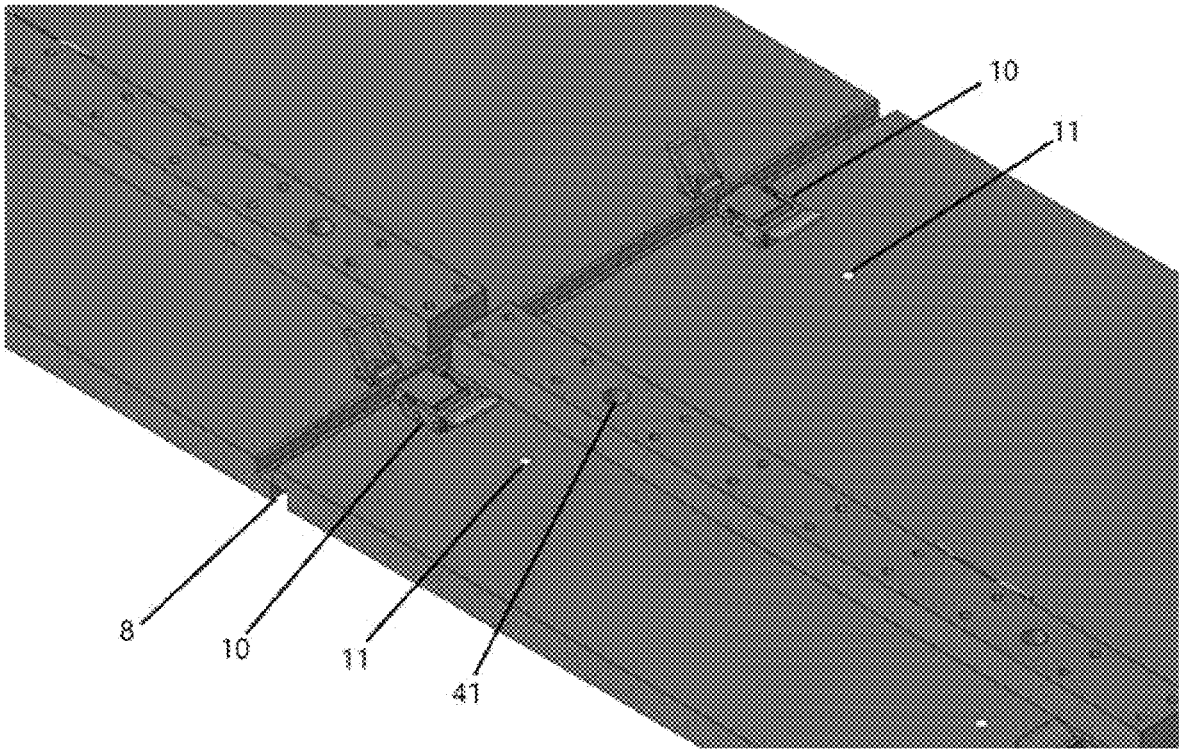
FIG. 27 is an enlarged, front, bottom perspective view (from slightly below) of a second embodiment of the bartop pieces selectively adjoined by cooperative bartop edge routing.
Figure 28:
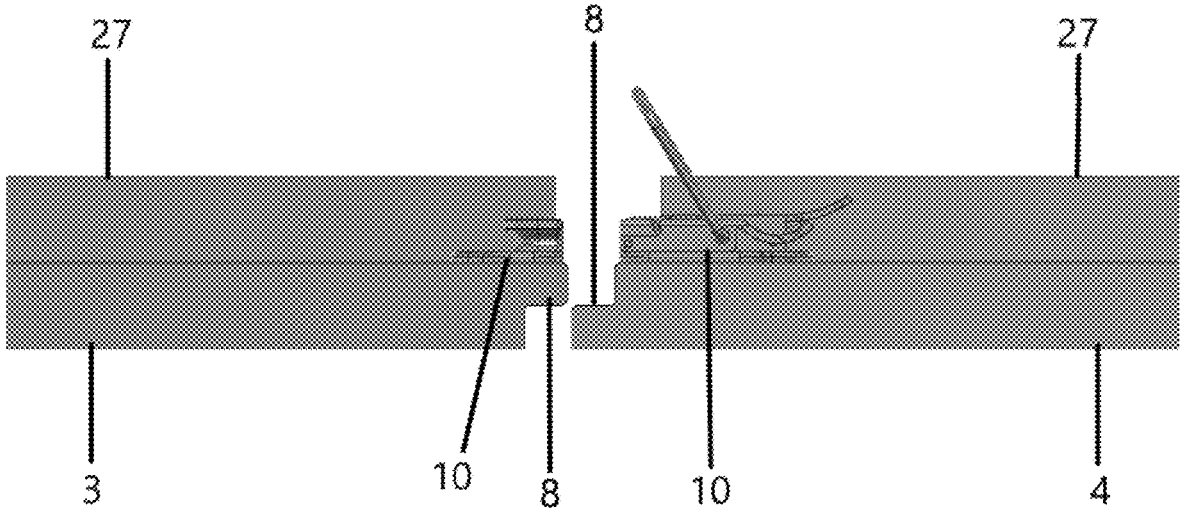
FIG. 28 is an enlarged, side perspective view (from same level) of the second embodiment of the bartop pieces in FIG. 27.

FIGS. 27-28 illustrate a second embodiment of the bartop wherein adjacent bartop pieces 2, 3, 4, 5 are selectively interlocked in the open position by utilizing a bartop edge routing 8 technique to pair cooperative edges of at least one bartop piece with the matching edge of at least one other adjacent bartop piece. The contours of opposing edges will increase joint stability and add support by dispersing weight and pressure amongst the bartop pieces 2, 3, 4, 5. Alternately, the alignment pin/hole configuration and the bartop edge routing configurations can potentially be used simultaneously in order to maximize stability.

FIGS. 8 and 24-28 illustrate buckle latches 10 affixed to an underside of the bartop 2, 3, 4, 5, each buckle latch 10 comprising a hook and a loop which cooperate to selectively hold adjacent bartop pieces 2, 3, 4, 5 together and further secure the assembled bartop 1 in the open position. These buckle latches 10 help aid in the overall stability of the apparatus.

FIGS. 25-26 illustrate buckle latch magnets 11 on an underside of the bartop. When the hook and loop of a given buckle latch 10 are not engaged, the loop component hangs loose. The buckle latch magnets 11, embedded in the underside of at least one bartop piece, serves to hold a loop of a given buckle latch 10 secure and in place instead of allowing it to hang loose when said buckle latch 10 is not engaged.

Figure 8:
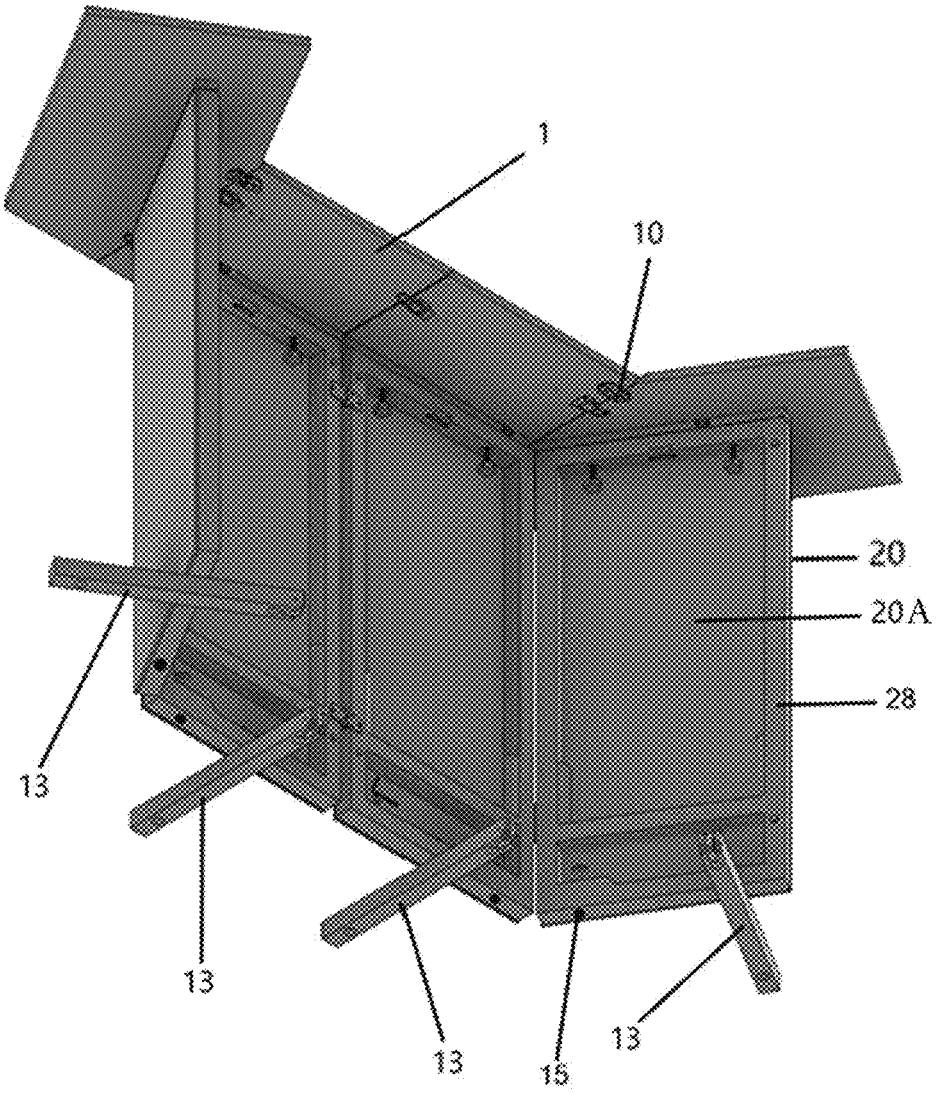
FIG. 8 is a rear, bottom-left perspective view (from slightly below) of the assembled bar in the open position for use.
Figure 9:
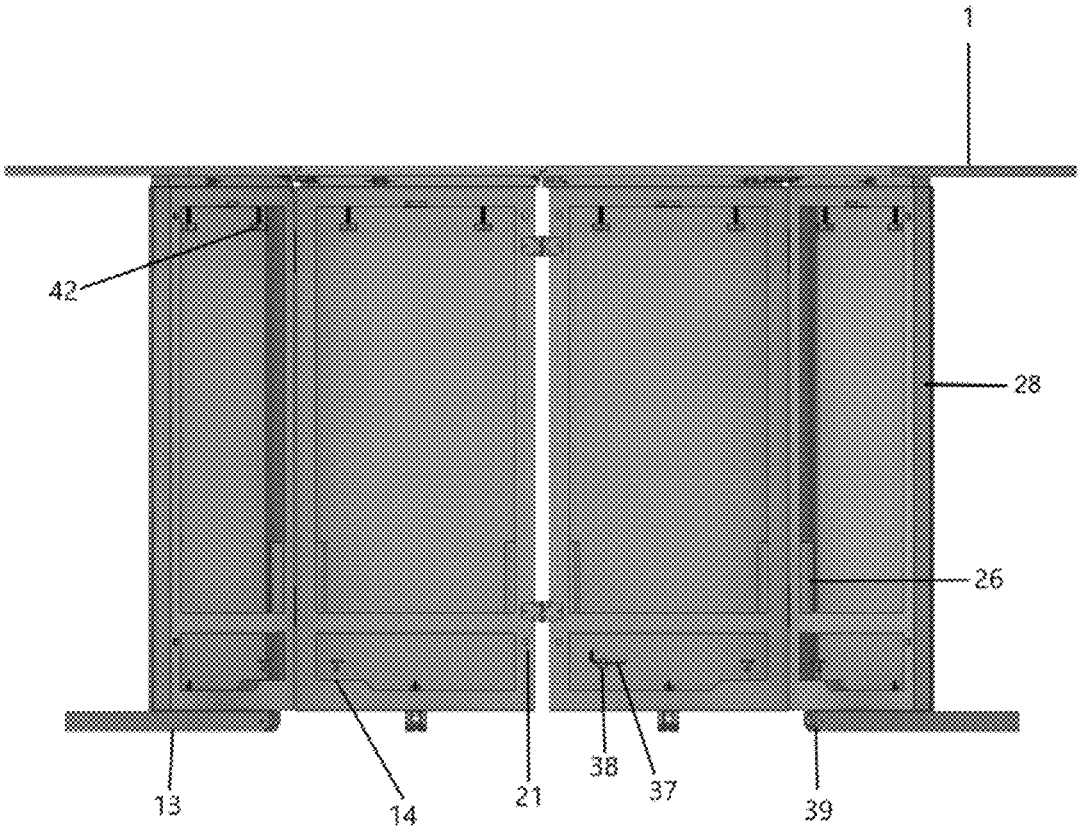
FIG. 9 is a rear side view (from same level) of the assembled bar in the open position for use.
Figure 22:
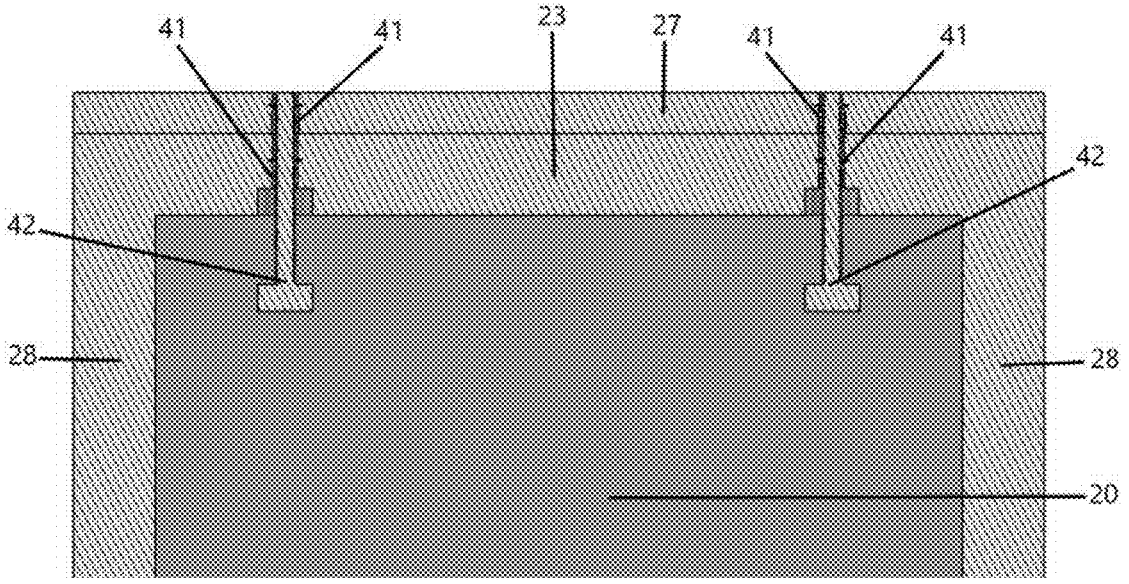
FIG. 22 is an enlarged, sectional, rear side view (from same level) of an underside connector of a bartop piece mounted to a horizontal support of a corresponding frame.
Figure 23:
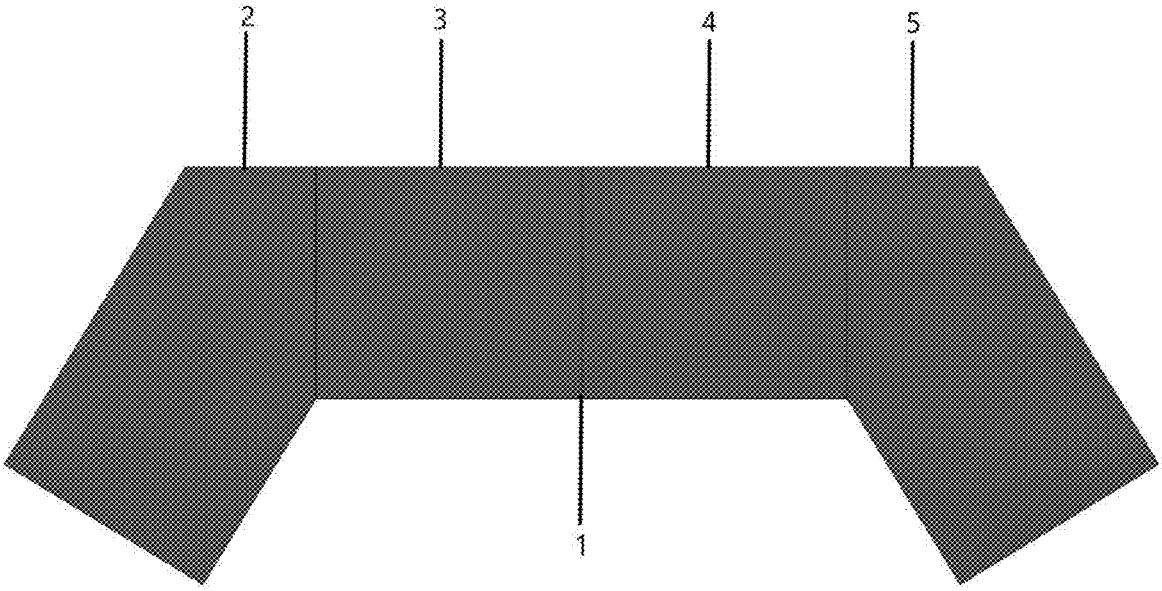
FIG. 23 is a top perspective view of the assembled bartop formed from adjoined component bartop pieces in the open position.
Figure 24:
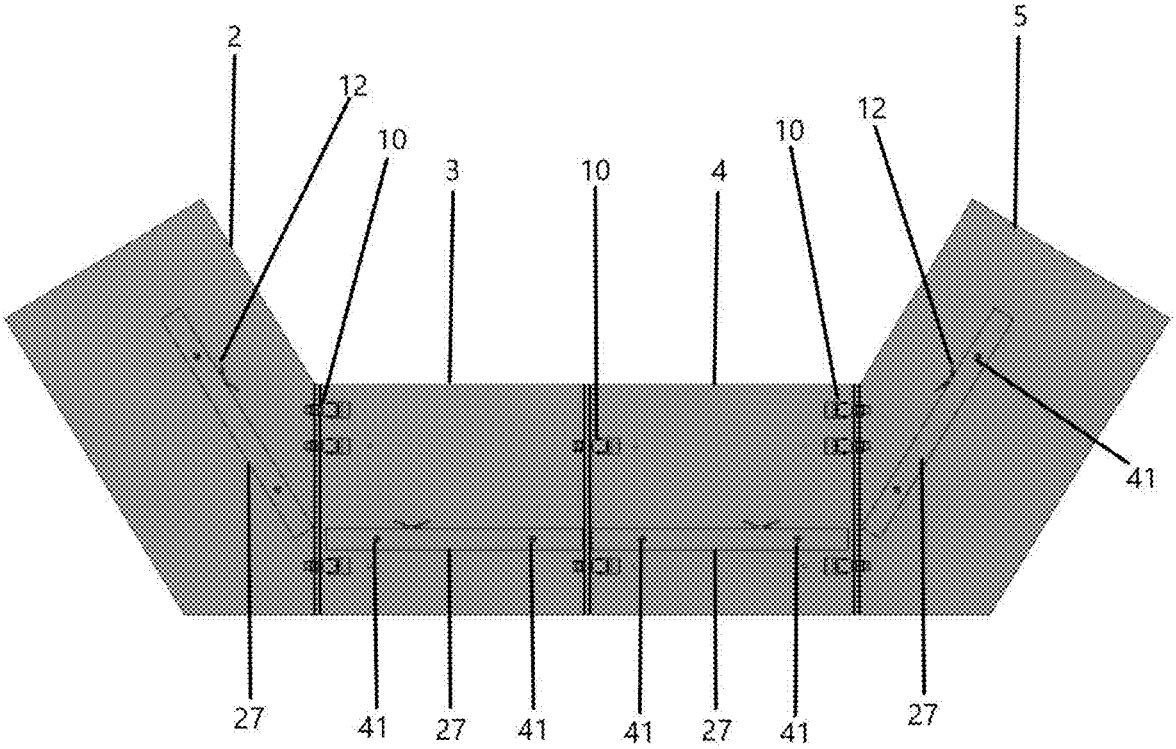
FIG. 24 is a bottom perspective view of the assembled bartop in FIG. 23.

FIGS. 8, 9, and 22 illustrate a cleat 12 and lace 24 configuration that serves to selectively secure each bartop piece 2, 3, 4, 5 within a recess of each respective corresponding frame 20 while not in use. To accomplish this security, each frame 20 is attached to a lace 24 that is looped around a corresponding cleat 12 located on an underside connector 27 of a corresponding bartop piece 2, 3, 4, 5 and the user can cinch-down the lace 24 to tighten and firmly secure a given bartop piece within a recess of the corresponding frame that forms a frame storage compartment. The lace 24 is a string that is permanently connected to a lower horizontal support 25 of each frame 20 at one end. Said cleat and lace configuration is used to secure the bartop pieces 2, 3, 4, 5 in place within recesses of their respective corresponding frames 20 when not in use by looping the lace 24 around the cleat 12 affixed to an underside connector 27 on a bottom surface of each bartop piece 2, 3, 4, 5. The lace 24 and cleat 12 are tied together much like a boat is tied to a dock. There are other possible methods that could be used to secure the bartop pieces 2, 3, 4, 5 into place, but this is the method on display in the figures.

FIGS. 8, 9, 22, and 24-28 illustrate an underside connector 27 located on an underside of each bartop piece 2, 3, 4, 5. The underside connector 27 is permanently attached to an underside of each respective bartop piece 2, 3, 4, 5. There is one underside connector 27 per bartop piece 2, 3, 4, 5. The underside connector 27 has embedded threaded inserts 41 that correspond to the location of the threaded inserts 41 in its corresponding horizontal support 23. The threaded knobs 42 from the horizontal support 23 run through the threaded inserts 41. The engagement of the underside connector 27 and the horizontal support bar 23 via the threaded knobs 42 secure each bartop piece 2, 3, 4, 5, to their respective corresponding frame 20 in the open position during use. Another possible method to secure the bartop pieces to the frames in the open position is a magnetic locking mechanism that, when activated, would also accomplish a connection between the bartop pieces and their respective corresponding horizontal supports. The underside connector 27 could also potentially be built into each existing frame 20, eliminating the need to attach a separate board—the underside connector 27—to each bartop piece.

Figure 11:
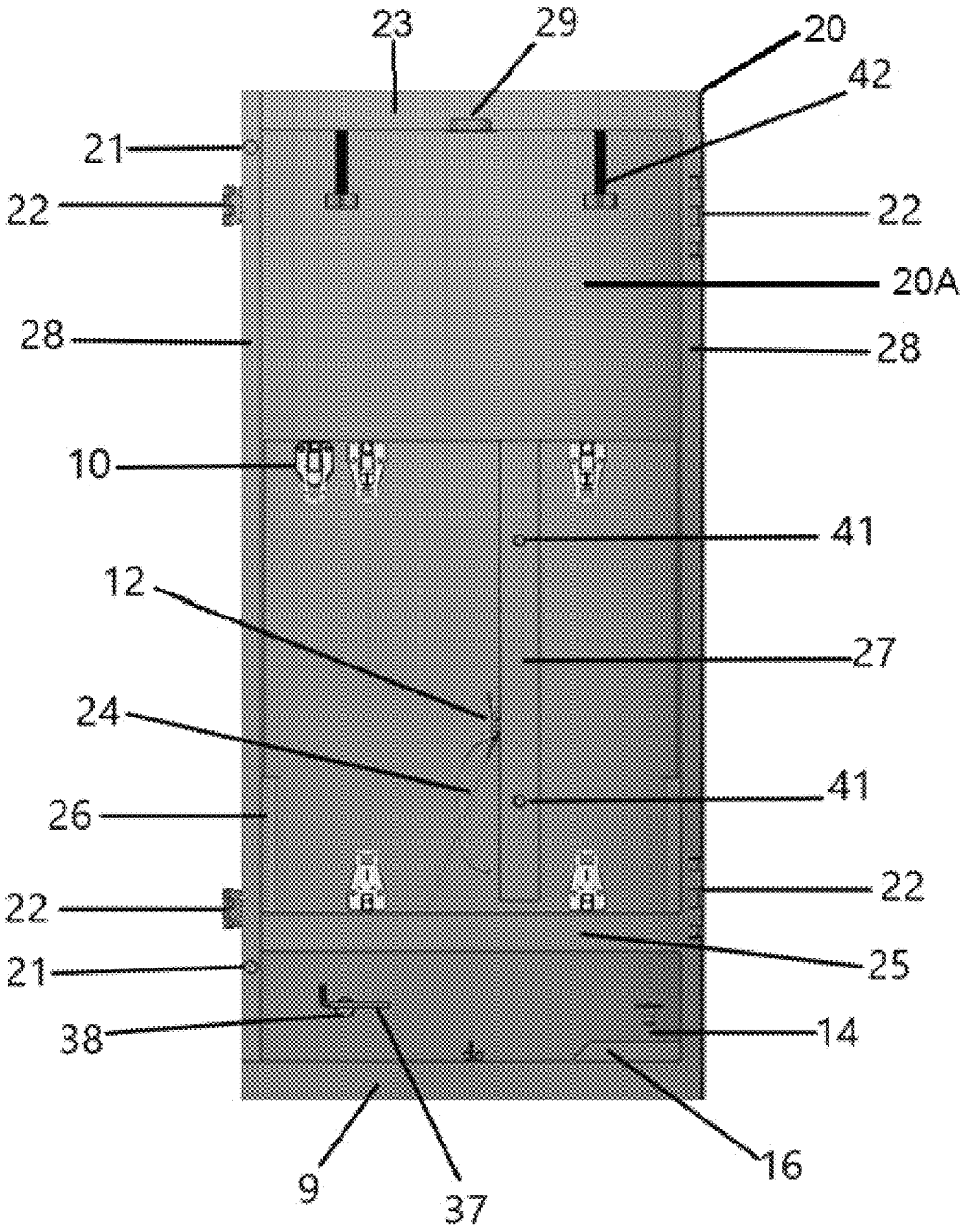
FIG. 11 is a rear side perspective view (from same level) of an individual frame and its internal components.

FIG. 11 illustrates an individual frame 20 and its internal components. The frame assembly of the bar consisting of the plurality of frames 20 pivotally attached to each other is a critical part of the apparatus. Each frame 20 of the frame assembly serves to store each respective bartop piece 2, 3, 4, 5 within a recess in the closed position when the bar is not in use. Each frame 20 may comprise two vertical sidings 28, one base support 9, one lower horizontal support 25, at least one storage stopper 26, a footing locking block 16, a lace 24, one horizontal support 23, and a frame panel 20A.

FIGS. 1, 10, 11, 12, and 22 illustrate the horizontal support(s) 23 of the frame(s) 20. The horizontal support 23 is located at the very top of each frame. It attaches the two vertical sidings 28 on a top end, as does the base support 9 on a bottom end. The horizontal support 23 is where a respective bartop piece 2, 3, 4, 5 locks into position for use. Threaded knobs 42 are housed in each horizontal support 23 via threaded inserts 41. To secure the bartop pieces 2, 3, 4, 5 to a top of their respective corresponding horizontal support 23 for use, the threaded knobs 42 are wound-up into each bartop piece's underside connectors 27 via corresponding embedded threaded inserts 41. A magnetic locking mechanism could also potentially be used in the connection of the horizontal supports 23 and their respective corresponding underside connectors 27.

Figure 10:
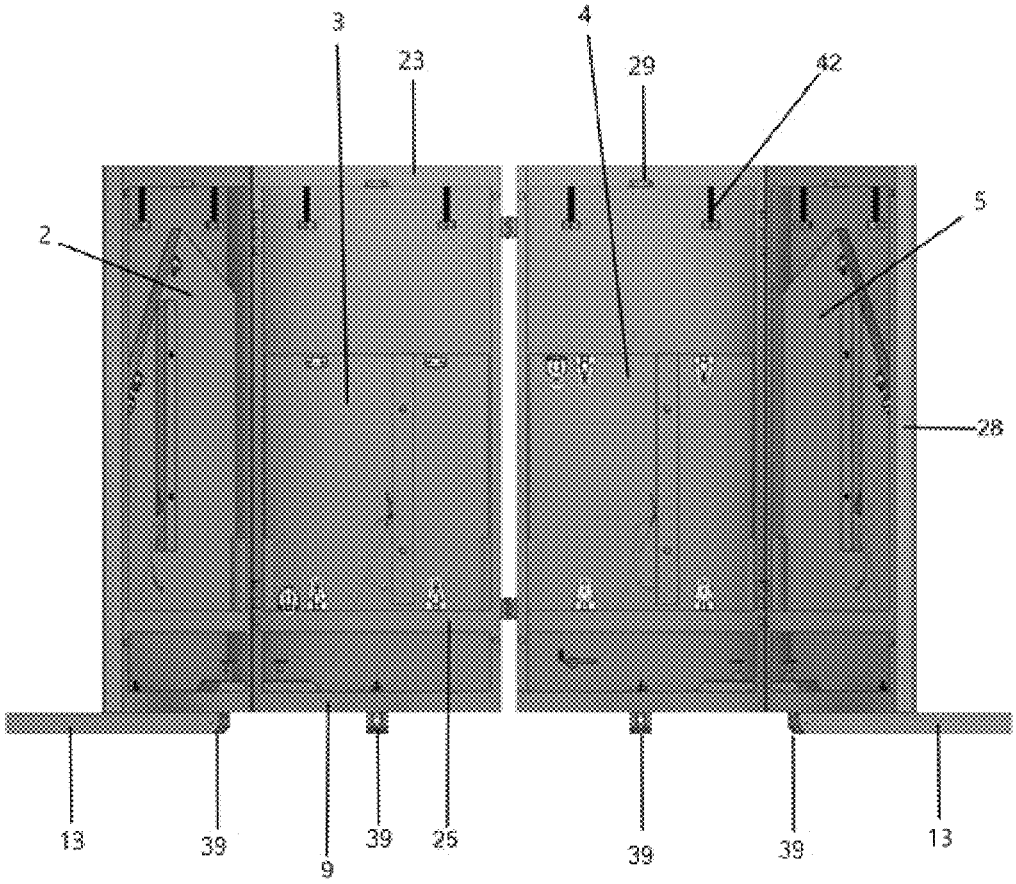
FIG. 10 is a rear side view (from same level) of the assembled bar in the open position wherein the bartop pieces are stored within corresponding frames of the frame assembly.

FIGS. 10 and 11 illustrate the lower horizontal support(s) 25 of the frame(s) 20. The lower horizontal support 25—sitting toward the bottom of its respective frame 20, set above the base support 9—supports the vertical sidings 28 of the frame 20 and serves as shelf on which a respective corresponding bartop piece 2, 3, 4, 5 rests when the bar is not in use and the bartop pieces 2, 3, 4, 5 are stowed away within their respective corresponding frames 20. The lower horizontal support 25 also contributes to each frame's strength, rigidity and integrity.

FIGS. 10, 11, 15 and 16 illustrate the base support(s) 9 of the frame(s) 20. The base support 9 is positioned at a bottom base of the frame 20, attaching the two vertical sidings 28 at the base of the frame 20. It is also used to secure the footing 13 to the frame 20 via either a cooperative threaded bolt 43 and threaded insert 41 configuration or a cooperative threaded T-bolt 44 and T-track 45 configuration, depending on the frame 20 in question. The threaded bolt 43 or alternately the threaded T-bolt 44 both run through the base support 9 and are attached to the footing 13, allowing for the footing 13 attached to the frame 20 to be tightened together or loosened apart by manipulating (i.e. rotating) a washer wingnut 46. The washer wingnut 46 is located on the threaded bolt 43 or threaded T-bolt 44 above the base support 9. Not every base support 9 will necessarily attach to the footing 13 via the threaded bolts 43 at exactly the same position. The positioning of the connection between the base support 9 and footing 13 will depend on the frame 20 and its location within the overall apparatus (i.e. for the outermost frames, the connection point may be closer to an edge of the base support, as opposed to a more central location for the innermost frames, which allows for increased stability when in the open position).

FIGS. 1-4, 8-12, and 22 illustrate the vertical sidings 28 of the frame(s) 20. The vertical sidings 28 serve as the left and right edges of each frame 20 and consists of two boards that run parallel to one another. Each board of the vertical sidings connects to a top of the frame 20 at opposite ends of the horizontal support 23 and to the bottom of the frame 20 at opposite ends of the lower horizontal support 25 and base support 9. The vertical sidings 28 are designed to increase the strength of the frame(s) 20 and its ability to support weight on the assembled bartop 1 when in use.

FIGS. 9 and 11 illustrate storage stoppers 26 of the frame(s) 20. The storage stoppers 26 serve to hold the bartop pieces 2, 3, 4, 5 in position within a recess of their respective corresponding frames 20 when the bar is not in use or is being transported. The storage stoppers 26 are positioned at the intersection of the lower horizontal support 25 and the vertical sidings 28, resting atop the lower horizontal support 25. The storage stoppers 26 are positioned so that there is a gap between them and the frame panel 20A, allowing space for the respective corresponding bartop piece 2, 3, 4, 5 to be stored when the apparatus is not in use. The storage stoppers 26—in conjunction with the lace 24 and cleat 12—prevents the bartop pieces 2, 3, 4, 5 from moving within their respective frames 20 while not in use.

FIGS. 1-3, 5-8, 12, and 22 illustrate the frame panels 20A of each corresponding frame 20. The frame panel 20A is the solid board that covers the exterior of the frame 20. It also serves to contain a corresponding bartop piece when not in use and in the closed position. The frame panels 20A, along with the assembled bartop 1, are the primary aesthetic embodiments when the apparatus is in use. The frame panels 20A provide opportunity for personalization of the apparatus through the application of designs, coloring, logos, etc.

FIGS. 1-7 illustrate the hinges 22 pivotably attaching the frames 20 of the frame assembly. Hinges 22 are attached to each frame 20 on at least one edge that lies adjacent to another frame while the apparatus is assembled in the open position. The hinges 22 serve to connect the adjacent frames 20 to one another, creating a single unit. However, the hinges 22 also allow for the apparatus to be alternately in the open position and the closed position which, in turn, allows the bar to be a compact unit for storage when the apparatus is not in use. The hinges 22 are affixed to the frames 20 in such a way—on opposing joints—that allows the frames 20 of the frame assembly to fold together like an accordion.

Figure 12:
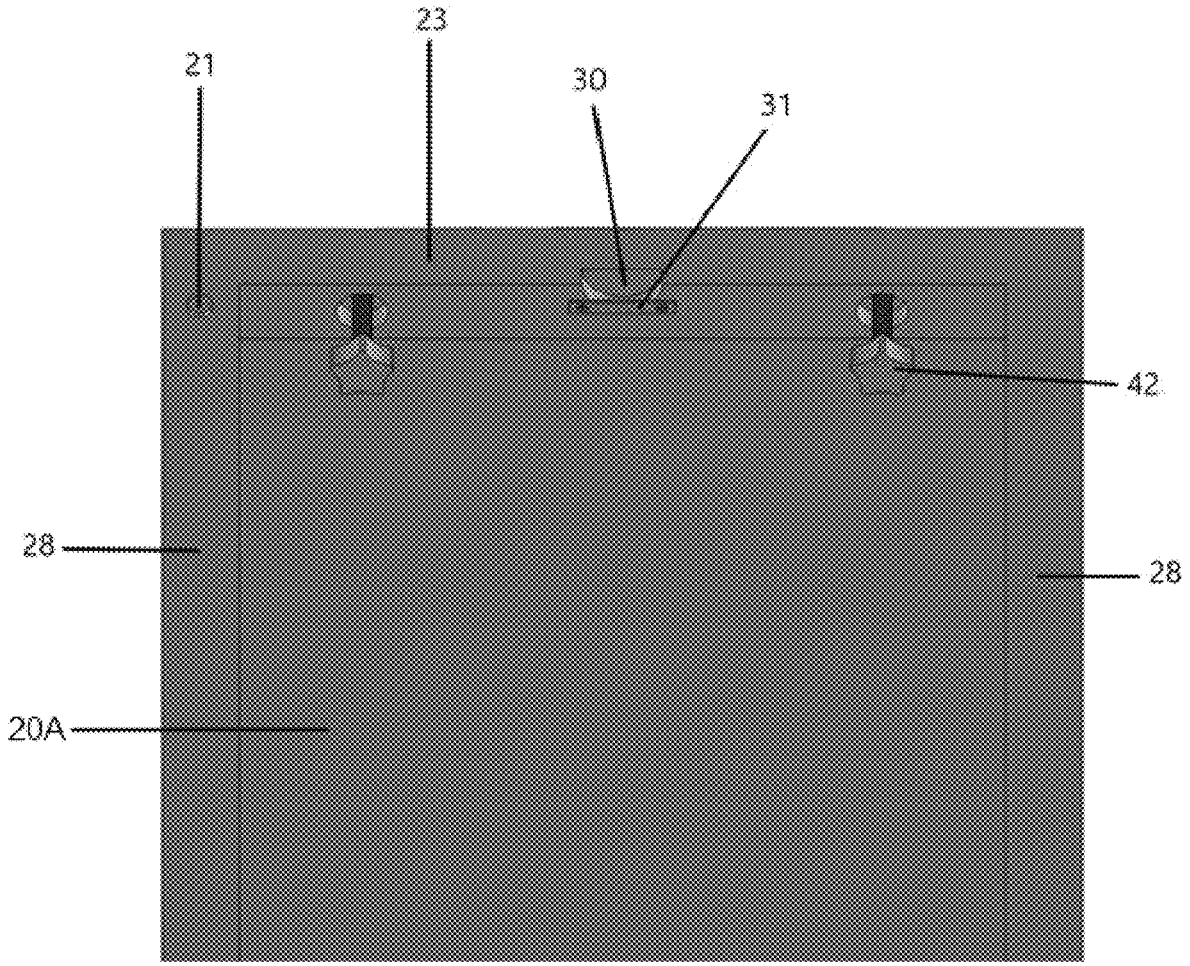
FIG. 12 is an enlarged, rear perspective view (from slightly below) of an individual frame.

FIGS. 11-12 illustrate frame locking magnets 21 attached to the frames 20 to hold the frame assembly in the closed position. The frame locking magnets 21 are positioned, as pairs, at the corners of each frame 20. A first magnet of a pair of frame locking magnets 21 is embedded into the corner of a frame 20, and the second magnet of the pair is embedded into the corner of the adjacent frame 20. (The second corner is the one that lies against the first when the apparatus is in the closed position). The magnetic pull between the magnets holds the frames 20 together when not in use. Each frame 20 does have locking magnets 21, but not in every corner. The corners in which the locking magnets 21 are embedded will depend on the overall organization/design of the apparatus and how the frame panels 20A fold together. The locking magnets 21 can be embedded on both an interior and an exterior of the frame 20.

Figure 13:
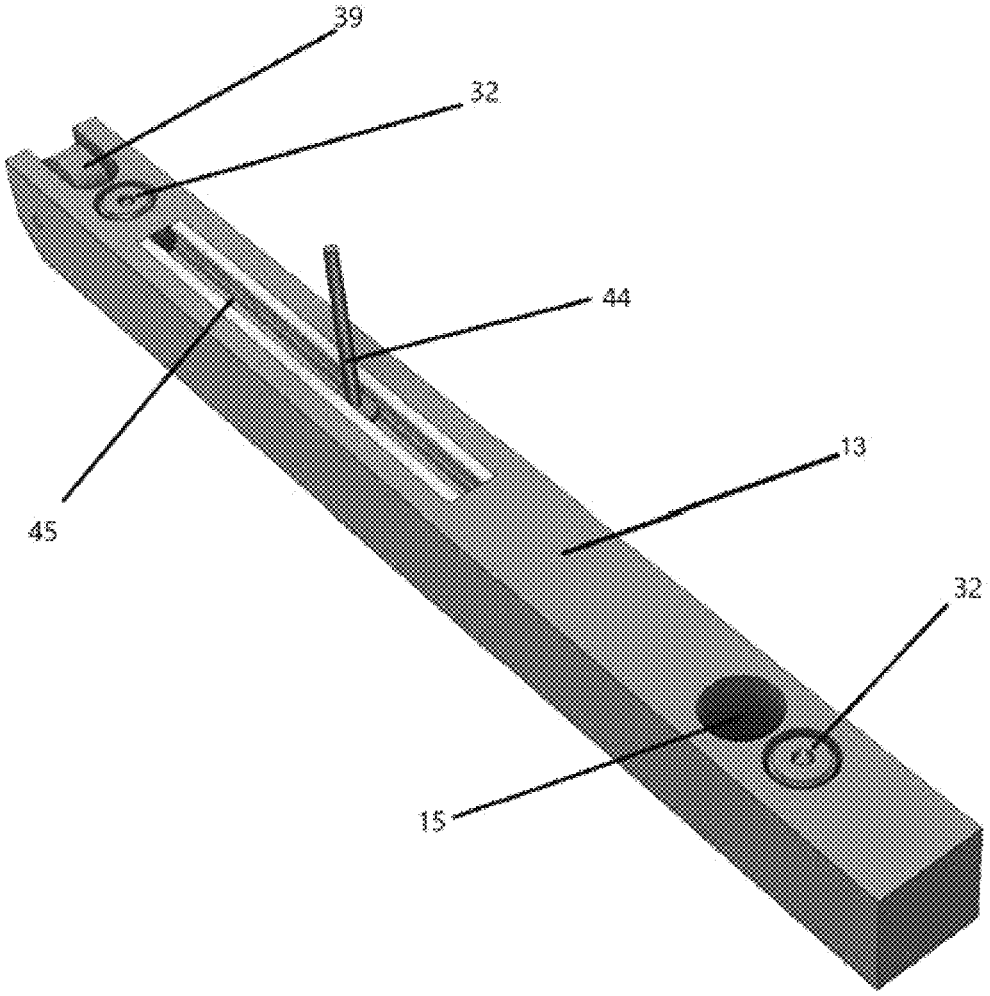
FIG. 13 is a top side perspective view (from slightly above) of a first embodiment of an individual footing comprising a T-track and T-bolt configuration providing slidable attachment of said footing to its corresponding frame.
Figure 14:
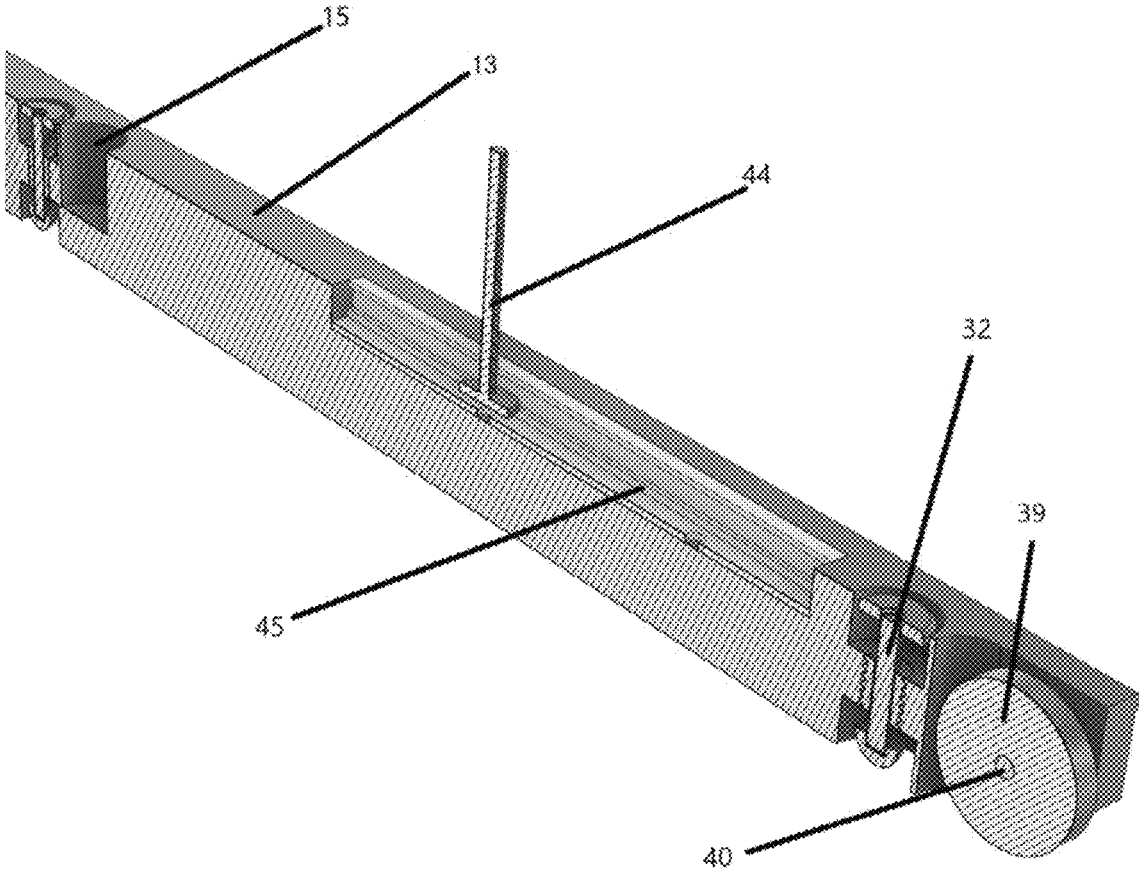
FIG. 14 is a sectional, top side perspective view (from slightly above) of the first embodiment of the individual footing in FIG. 13 comprising the T-track and T-bolt configuration.
Figure 15:
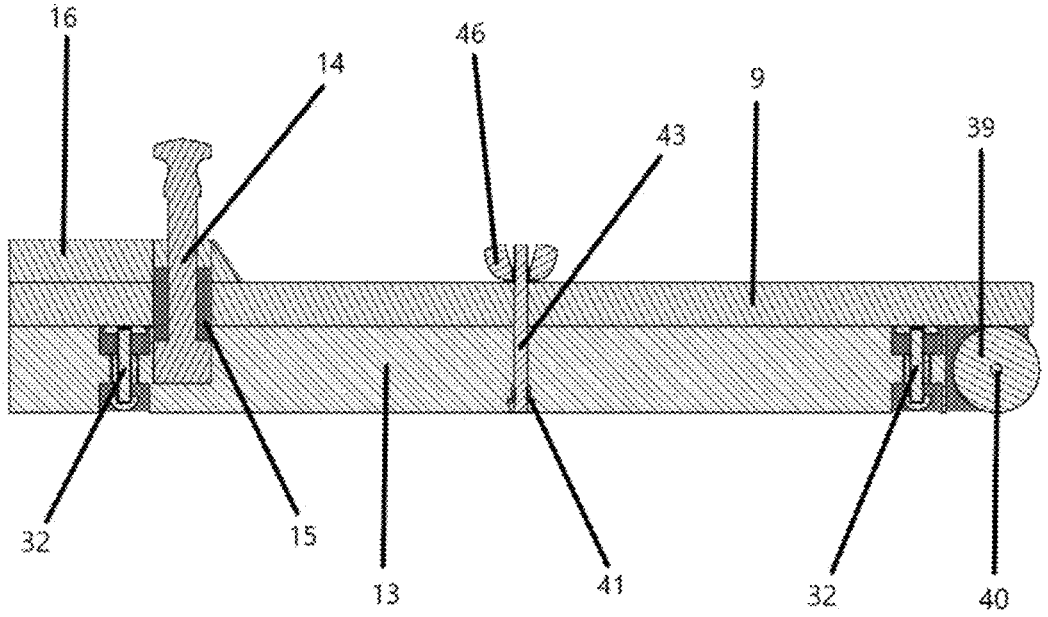
FIG. 15 is a sectional, side perspective view (from same level) of a second embodiment of an individual footing comprising a threaded bolt and threaded insert configuration providing rotatable attachment of said footing to its corresponding frame.
Figure 16:
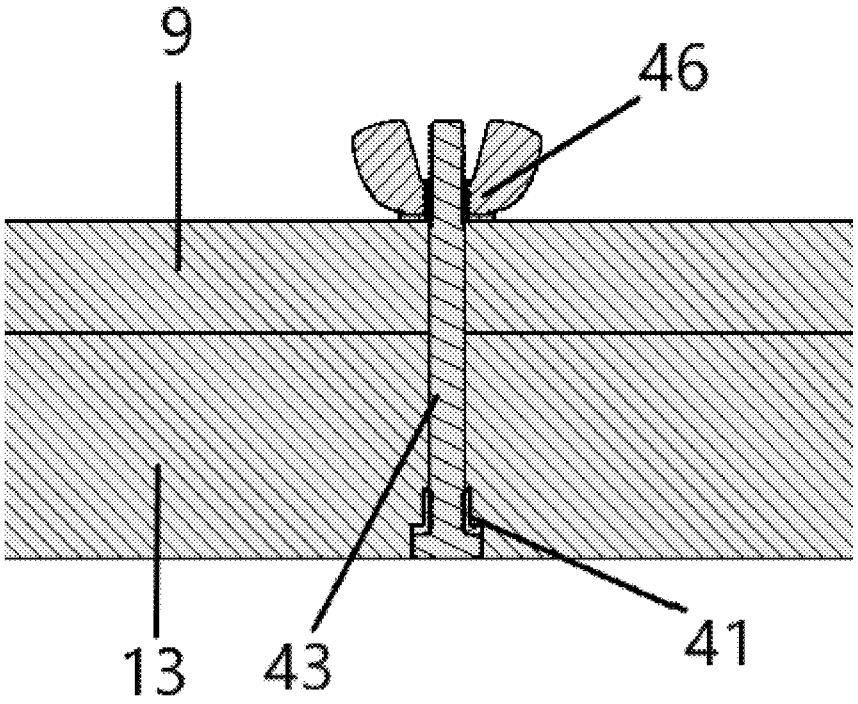
FIG. 16 is an enlarged, sectional, side perspective view (from same level) of the second embodiment of the individual footing in FIG. 15 comprising the threaded bolt and threaded insert configuration.
Figure 17:
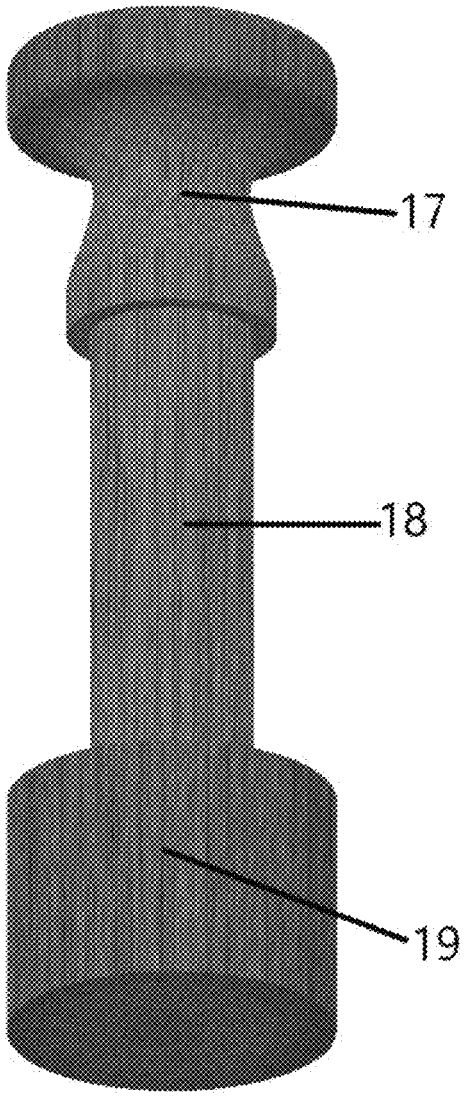
FIG. 17 is an enlarged, front perspective view (from slightly below) of a dowel rod of an internal footing locking system.
Figure 18:
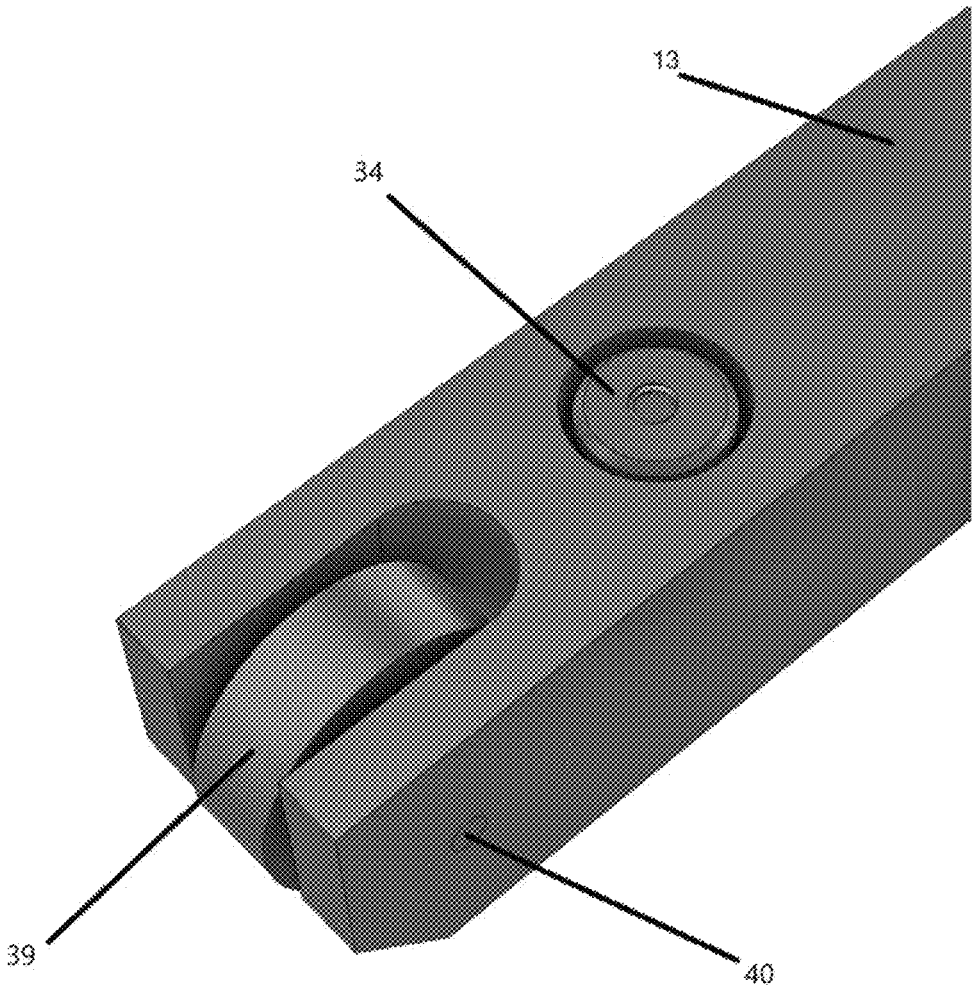
FIG. 18 is an enlarged, top side perspective view (from slightly above) of an end of an individual footing having a wheel.
Figure 19:
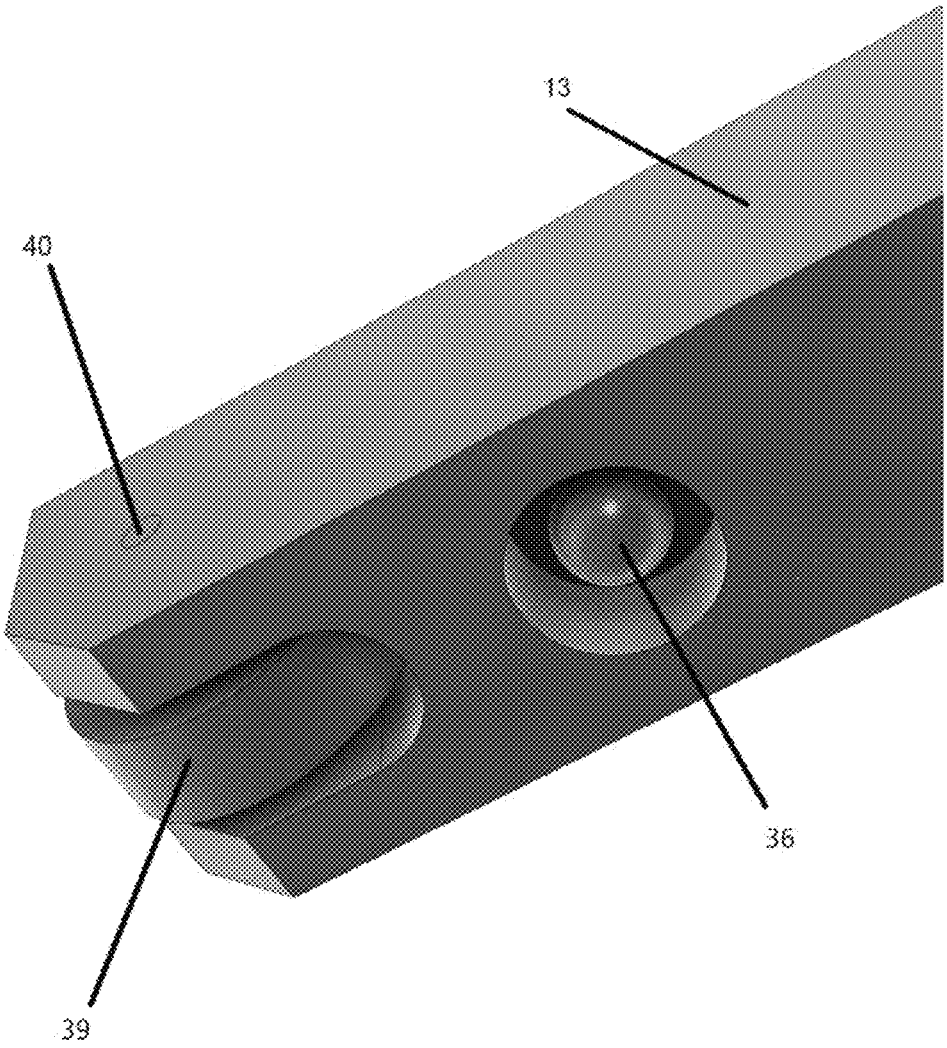
FIG. 19 is an enlarged, bottom side perspective view (from slightly below) of the end of the individual footing in FIG. 18.

FIGS. 4, 7-8, 10-11, 13-14, and 16-20 illustrate the swivel footings 13 movably attached to the base supports 9 of their respective frames 20. The footing 13 is attached to the base support 9 of its respective frame 20 and, when the apparatus is open and in use, maintains contact with the ground surface on which it is engaged. The footings 13 are able to pivot out from the closed position in order to increase the stability of the apparatus when in use. The footing 13 is an elongated rectangular block having the same length and width as the base support 9. The footing 13 is connected to the base support by either a cooperative threaded bolt 43 and threaded insert 41 configuration (as illustrated in FIGS. 15-16) or a cooperative threaded T-bolt 44 and T-track 45 configuration (as illustrated in FIGS. 13-14), depending on the footing 13 in question and its corresponding frame 20. The threaded bolt 43 or alternately the threaded T-bolt 44 both run through the base support 9 and are attached to the footing 13, allowing for the footing 13 attached to the frame 20 to be tightened together or loosened apart by manipulating (i.e. rotating) a washer wingnut 46. The washer wingnut 46 can be a more beneficial fastening method than a standard nut, due to its larger diameter and greater clamping pressure which, when applied, adds to the stability of the apparatus. A countersunk hole on an underside of the footing 13 allows the threaded bolt 43 to be hidden within the footing, increasing aesthetics and allowing said footing 13 to lay flush on a flat surface.

Figure 7:
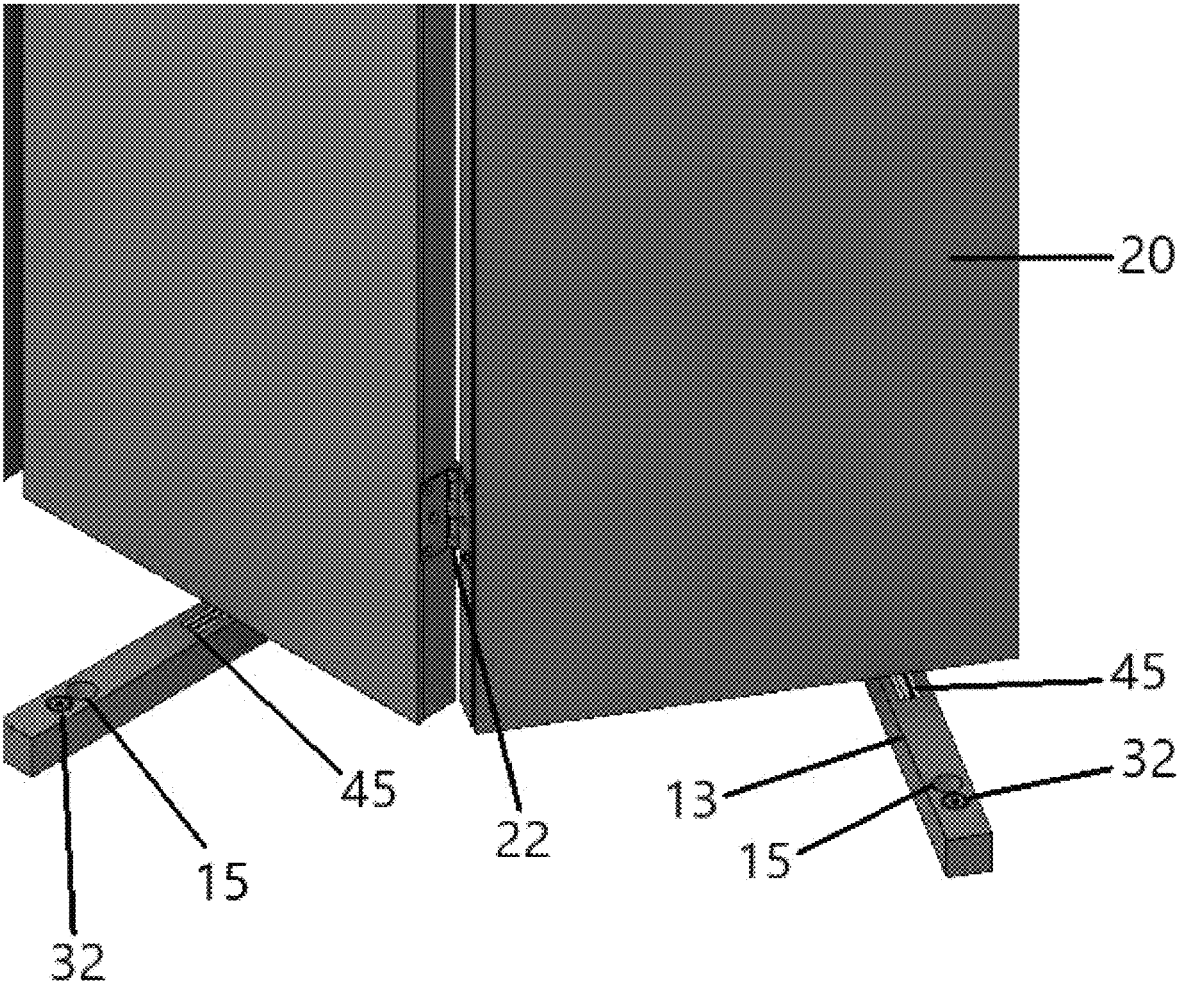
FIG. 7 is an enlarged, front lower-right perspective view (from slightly above) of the assembled bar in the open position for use.

FIGS. 7 and 13-14 illustrate a first embodiment of an individual footing 13 comprising a T-track 45 and T-bolt 44 configuration providing slidable attachment of said footing 13 to its corresponding frame 20. In said first embodiment a method that can be utilized to attach the base support 9 to a corresponding footing 13 is the T-track 45 and threaded T-bolt 44 fastening configuration. The T-track 45 allows the threaded T-bolts 44 "T" shaped head to slide within its internal grooves. The threaded T-bolt 44 is set inside the T-track 45 (which is embedded in the footing 13) and can be moved from one end of the T-track 45 to another. This allows the user to position the footing 13 in the optimal location along an underside of the corresponding frame 20, accounting for stability and logistics. In one exemplary embodiment of the apparatus pictured, the two outermost frames 20 have footings 13 with the T-track 45 and threaded T-bolt 44 configuration (allowing for increased stability) and the two innermost frames 20 have footings 13 with the threaded bolt 43 and threaded insert 41 configuration.

FIGS. 15-16 illustrate a second embodiment of an individual footing 13 comprising a threaded bolt 43 and threaded insert 41 configuration providing rotatable attachment of said footing 13 to its corresponding frame 20. The footing's threaded bolt 43 and threaded insert 41 fastening configuration is a method that can be utilized to attach the base support 9 and the footing 13 in which a threaded bolt 43 runs through the base support 9 and is attached to the footing 13 using a threaded insert 41. The threaded bolt 43 has a washer wingnut 46 on its top end, atop the base support 9. The washer wingnut 46 can be tightened or loosened atop the base support 9 in order to secure the footing 13 into place or allow it to rotate/pivot open for use. The threaded bolt 43 and threaded insert 41 fastening configuration is featured in the apparatus pictured, but is not the only method that could be used for the footing of the apparatus.

FIGS. 8-12, 16, and 18 illustrate a footing locking system 14 for selectively fixing the footing 13 to the base support 9 when the device is in the closed position not in use. The footing locking system 14 is a mechanism used to hold the footings 13 in a closed position when not in use. When in the closed position, the footing 13 lies directly underneath the base support 9 and is flush with said base support on all sides. This footing locking system 14 prevents the footing 13 from rotating outward and into the open position when not in use. Additionally, this embodiment is particularly useful when the apparatus is in closed position and being wheeled, or otherwise transported, because the footing locking system 14 configuration ensures that the footing 13 stays in place despite the increased weight and pressure applied to it during this type of transition.

FIGS. 7-8, 11, and 13-15 illustrate a footing locking block 16 and footing locking system 14 footing locking counter-bore 15. The footing locking block 16 sits atop the base support 9. The footing locking counter-bore 15 within the footing locking block 16 is a cavity to receive the footing locking dowel head 19 when the footing 13 is being engaged for use. The user can pull upward on the footing locking knob 17 to move the footing locking dowel head 19, attached by the footing locking dowel rod 18, from its position in the footing 13 to its position within the footing locking block 16. This enables the footing 13 to slide and/or spin/rotate into the desired, open position. The footing locking block 16 also holds and acts as a guide for the footing locking dowel rod 18 to slide through during operation of the footing locking system 14 configuration.

Figure 20:
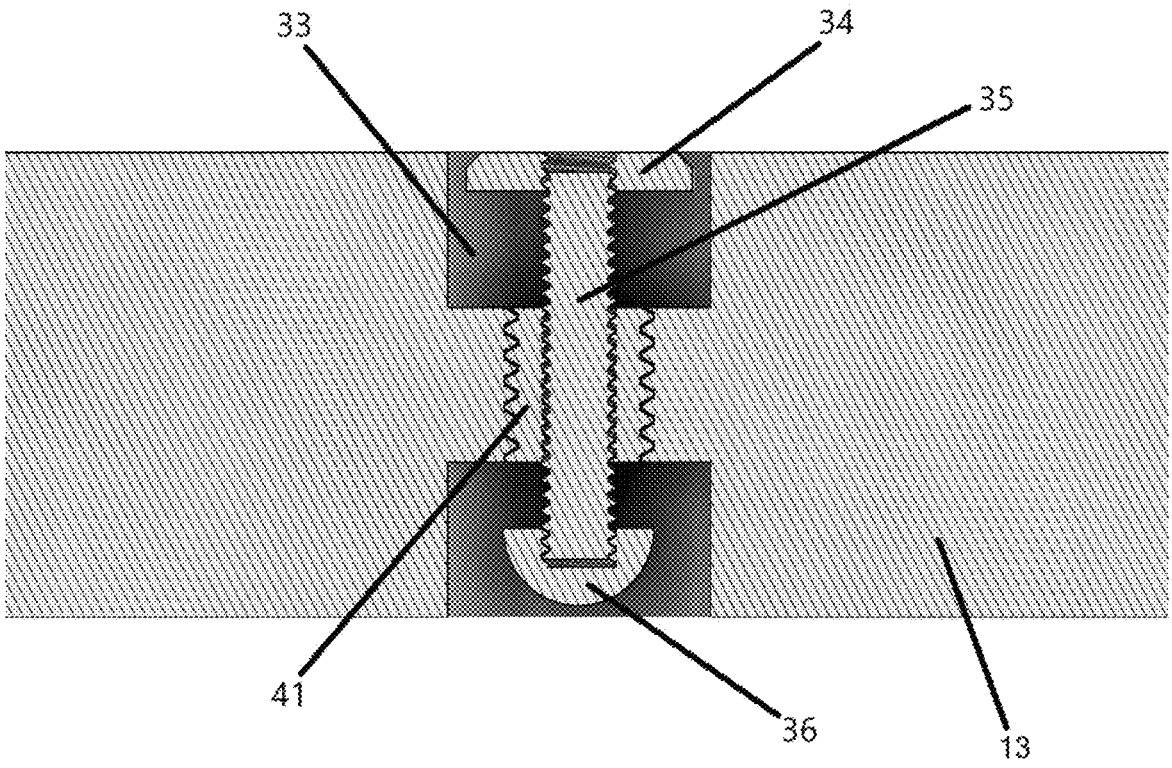
FIG. 20 is an enlarged, sectional side view (from same level) of an individual footing with an adjustable leveler.
Figure 21:
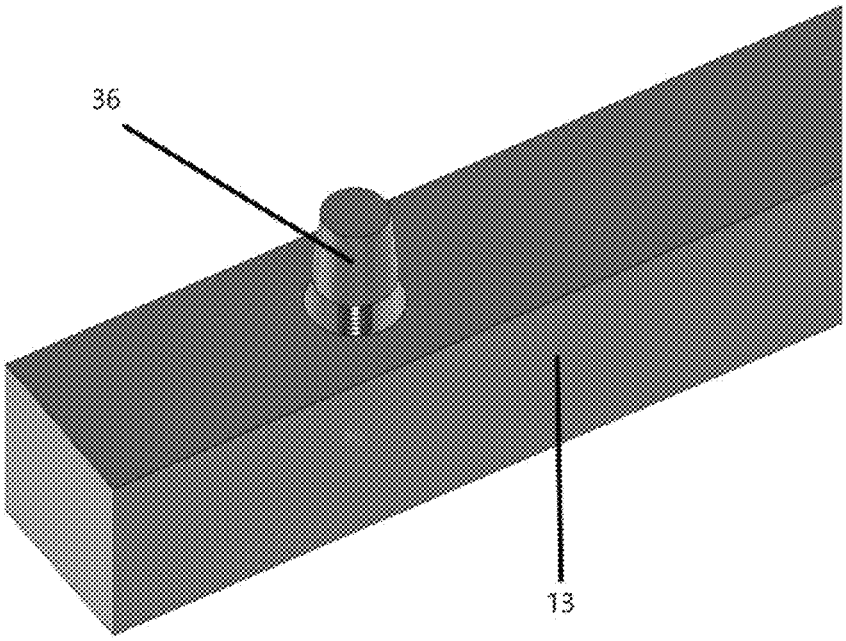
FIG. 21 is an enlarged, bottom side perspective view of an individual footing with an adjustable leveler tip extending therefrom.

FIGS. 11-15 and 17-18 illustrate a footing locking system 14 and the internal components that comprise it. The footing locking system 14 has internal components that, when utilized together, function as the mechanism that aids to lock the footing 13 in position. It consists of a footing locking knob 17, a footing locking dowel rod 18, and a larger diameter footing locking dowel head 19. The footing locking dowel rod 18 runs through the base support 9 and footing locking block 16 that sits atop said base support. Attached to a top of the footing locking dowel rod 18 is the footing locking knob 17. Attached to a bottom of the footing locking dowel rod 18 is the footing locking dowel head 19. The footing locking knob 17 is attached to a top of the footing locking dowel rod 18 on an end thereof that protrudes from the footing locking block 16 (as illustrated in FIG. 20). The footing locking knob 17 is manipulated by the user to change the position of the dowel head 19, by either pulling up or pushing down on said knob 17. On the opposite end of the footing locking dowel rod 18—the bottom end—is the footing locking dowel head 19. The dowel head 19 is wider (has a greater diameter) than the footing locking dowel rod 18 itself, which helps serve as a stop when the footing locking knob 17 is pulled upward in order to release the footing 13 from the footing locking system 14 mechanism. The footing locking dowel head 19 is the piece that either locks the footing 13 into the closed position or is released to allow the footing 13 to rotate/pivot into the open position. When locked into the closed position, the footing locking dowel head 19 is pushed down into a cavity called the footing locking counter-bore 15, holding the footing 13 in position. When the footing 13 is engaged and the apparatus is in use, the footing locking dowel head 19 is pulled up into a cavity in the base support 9 called the footing locking system base support counter-bore 15, which frees the footing 13 to be rotated/pivoted out into the open position for use. Additional, possible options for securing the footing 13 in place when in the closed position are footing locking magnets and footing locking threads. These other options could be implemented for the increased benefits of the user and/or manufacturer for improved functionality and/or aesthetics.

FIGS. 3-4, 7, 13-15, and 18-21 illustrate the leveler(s) 32 of the footing(s). The levelers 32 are located in the footing 13, with one leveler 32 at each end of the footing 13. It can be positioned in another location, but the end of the footing 13 may be the most beneficial. The leveler 32 is an optional, additional embodiment to be considered in increasing stability of the apparatus when in use. This element is particularly useful if the apparatus is being used on an uneven surface. The leveler 32 allows for manual leveling of the apparatus on uneven ground; they can be lowered from the footing 13 to make contact with the ground, if necessary, and help eliminate wobble or tilt when the apparatus is in use on ground that is not level or even. The levelers 32 are also hidden/stored within the footing 13 so that they cannot be seen unless they need to be utilized and are engaged.

FIGS. 3-4, 7, 13-15, and 18-21 illustrate the leveler(s) 32 and its associated components. The leveler 32 has several components that allow it to function. The leveler head 34 is the top part of the leveler 32 element; which the user can access in the footing 13. The leveler threaded rod 35 is held in position with a threaded insert 41 that is embedded within the footing. At an end of the leveler threaded rod 35 is the leveler tip 36, wherein said leveler tip 36 is the part of the leveler 32 that will make contact with the ground. The leveler head 34 and the leveler tip 36 are able to wind-down or back up into storage due to the space cavity that the leveler counter-bore 33 provides.

FIGS. 9 and 11 illustrate the leveler wrench key 37 for adjusting the levelers 32 and the associated leveler wrench magnet 38. The leveler wrench key 37 is used to lower the leveler 32 to engage with the ground or to raise the leveler 32 to rest in place within the footing 13. The leveler wrench key 37 is a tool that's own shape matches the leveler head 34 access. Using the leveler wrench key 37 with the leveler head 34 allows the user to wind-down or wind-up the leveler as desired. The leveling wrench key 37 will have a designated leveler wrench magnet 38 embedded within one of the interior frames 20, which is where it will be housed when not in use. This magnet serves as a place for the leveler wrench key 37 to be stored, so that it is not a loose piece prone to misplacement.

FIGS. 2-4, 9-10, 13-15, and 18-19 illustrate the wheels 39 of each respective footing 13. The wheels 39 serve to make transportation of the apparatus significantly more manageable. They are positioned at the end of one side of each footing 13 so that when the apparatus is closed, all wheels 39 fall along the same bottom edge of the apparatus. The wheels 39 are almost fully embedded in the footing 13, protruding beyond flush just enough to enable them to engage with the ground when the apparatus is tilted for transport. Positioned in this way, the wheels 39 allow for the apparatus to be tilted and rolled. When tilted, the apparatus may be pushed or pulled along the ground to its desired location for use or for storage.

FIGS. 10-12 illustrate the bottle opener 29 attached to the frame assembly. The bottle opener 29 is designed to remove caps from beverage bottles. Although the addition of a bottle opener 29 is not essential to the mechanics of the apparatus, it does service as a useful and relevant component. The bottle opener 29 has a bored-out area, called the bottle opener counter-bore 30, and also has a bottle opener plate 31 which is positioned slightly overlapping the bottle opener counter-bore 30 cavity into which bottle tops can fit. The user can insert the bottle top into the opener at the opening of a circular cavity and position it snuggly under the bottle opener plate 31, and then use minimal force and leverage to pry the bottle cap off of the bottle.

FIGS. 15-16, 20, 22, 24, and 26-27 illustrate threaded inserts 41 of the bar utilized in securing/attaching different elements of the apparatus. A threaded insert 41 is a fastener that can receive a thread (i.e. a threaded rod). Threaded inserts 41 are used in numerous ways throughout the apparatus. By embedding a threaded insert 41 into one element of the apparatus, that element has the capability to be connected to another embodiment of the apparatus via a threaded rod. Thus, a threaded insert 41—combined with a threaded rod—can be used to conjoin separate embodiments of the apparatus. Some examples of where this connector is used in the apparatus include: the connection of the base support 9 and footing 13 via the threaded bolt 43; the connection of the horizontal support 23 and the underside connector 27; and the levelers 32 within the footings 13.

FIGS. 15-16 illustrate threaded bolts 43 of the bar utilized in securing/attaching different elements of the apparatus. Threaded bolts 43 are utilized throughout the apparatus, in various ways, to aid in the fastening of two objects. The threaded bolts 43 are used in conjunction with an opposing object with a corresponding threaded interior (i.e. threaded insert 41) or with a threaded nut (i.e. washer wingnut 46) on the opposite side to achieve the fastening.

FIGS. 9-12 and 22 illustrate threaded knobs 42 of the bar utilized in securing/attaching elements of the apparatus. The threaded knob 42 is a piece that can be affixed to the end of a threaded rod via a built-in, internal thread. The threaded knob 42 aids the user in manipulation of the rod by creating a gripper for the user's hand, which allows for easier twisting/winding of the threaded rod. The threaded knob 42 in the pictured apparatus can be found housed in the horizontal support 23.

FIGS. 15-16 illustrate use of the washer wingnut 46, wherein said washer wingnut 46 is a type of fastening nut that appears to be a hybrid of a washer and a wingnut. It is a wingnut that has a thin plate around the center hole at the end that engages with a surface. The purpose of this thin plate, much like a washer, is to distribute weight and force more evenly. The "wings" of the wingnut serve to aid the user in gripping the nut and make it much easier for the user to tighten or loosen the thread by hand (without the need for tools).

FIGS. 7, 13, and 14 illustrate a first embodiment of an individual footing 13 comprising a T-track 45 and T-bolt 44 configuration providing slidable attachment of said footing to its corresponding frame 20. In said first embodiment of the footing, a T-track 45 is embedded in the footing 13, with a top face flush with a top face of the footing 13. The T-track 45 allows for the footing's 13 placement to be manipulated, sliding either inward or outward along the underside of the frame 20. This allows the user to selectively position the footing 13 in the optimal location, accounting for stability and logistics. To secure the footing 13 into the selected T-track 45 position for use, the user tightens the washer wingnut 46 on the threaded T-bolt 44.

FIGS. 14-15 and 18-19 illustrate an axle 40 of the wheel 39 on each footing 13. The axle 40 is a small bar that runs through a wheel's 39 inner hole and serves as an axle for said wheel 39, serving much the same purpose as an axle in a car. The wheel 39 is able to roll and serve its role in transportation by rotating on the axle 40. The axle 40 should fit snuggly, but smoothly, in the wheel's 39 inner hole in order to minimize vibrations when engaged and in order to avoid unnecessary friction between the wheel 39 and axle 40.

Figure 2:
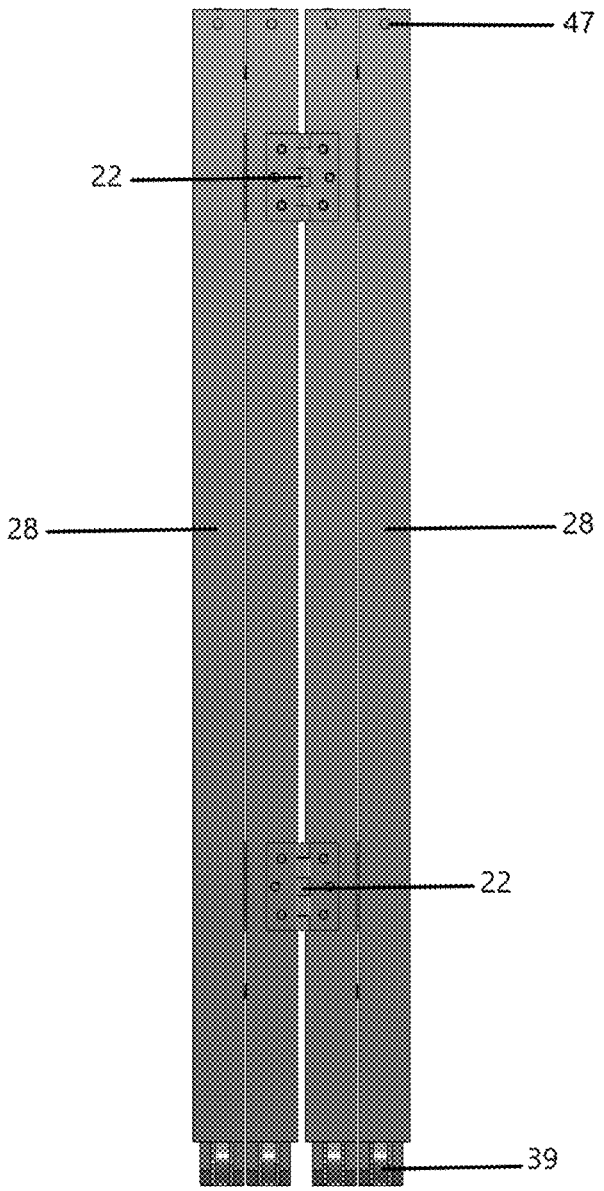
FIG. 2 is rear side perspective view (from same level) of the frames of the frame assembly collapsed in the closed position for transit or storage.
Figure 3:
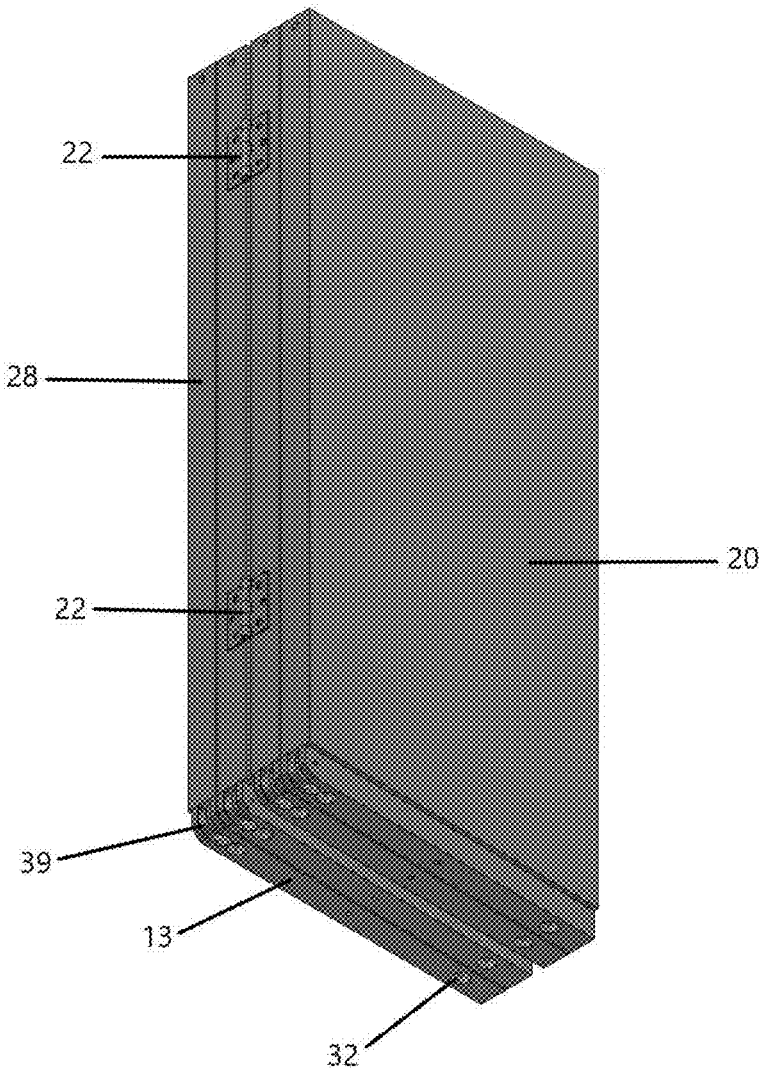
FIG. 3 is a bottom-right perspective view (from slightly below) of the frames of the frame assembly collapsed in the closed position for transit or storage.
Figure 4:
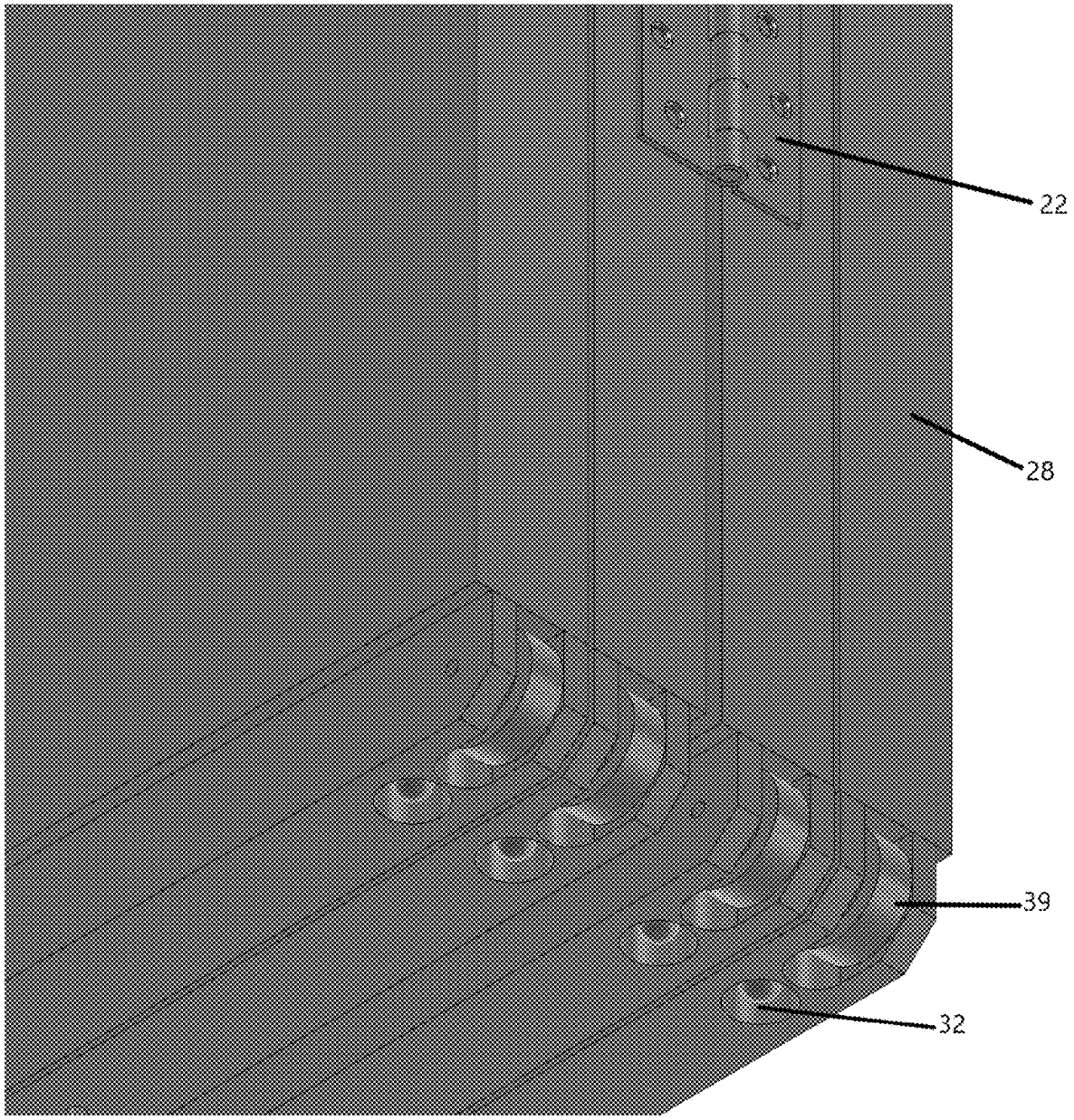
FIG. 4 is an enlarged rear bottom-left perspective (from slightly below) of the frames of the frame assembly collapsed in the closed position.
Figure 5:
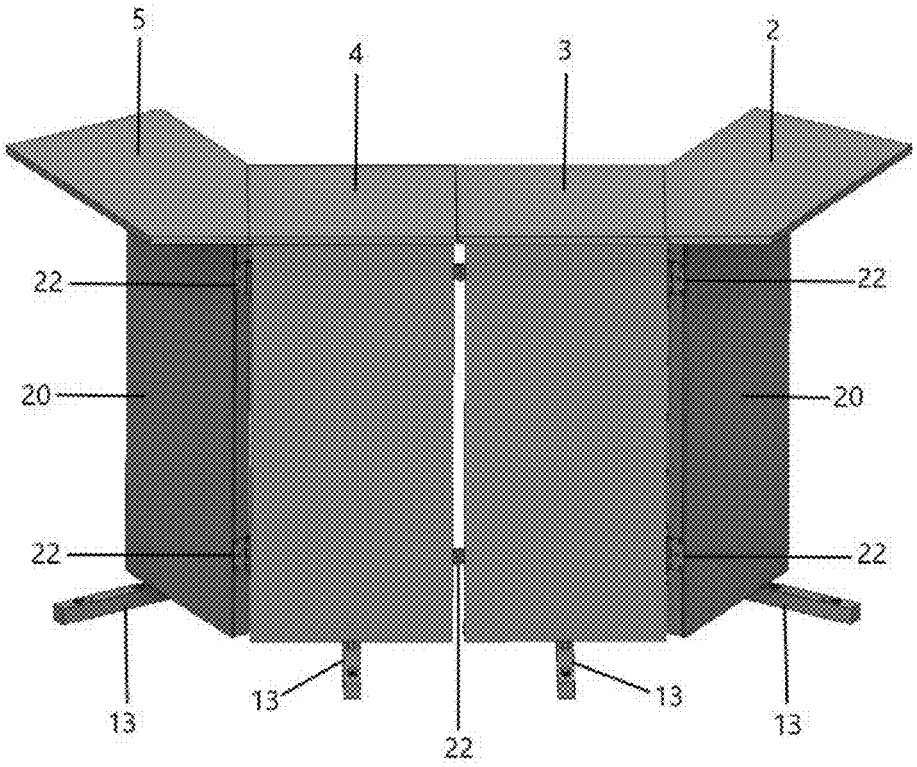
FIG. 5 is a front perspective view (from slightly above) of the assembled bar in the open position for use.
Figure 6:
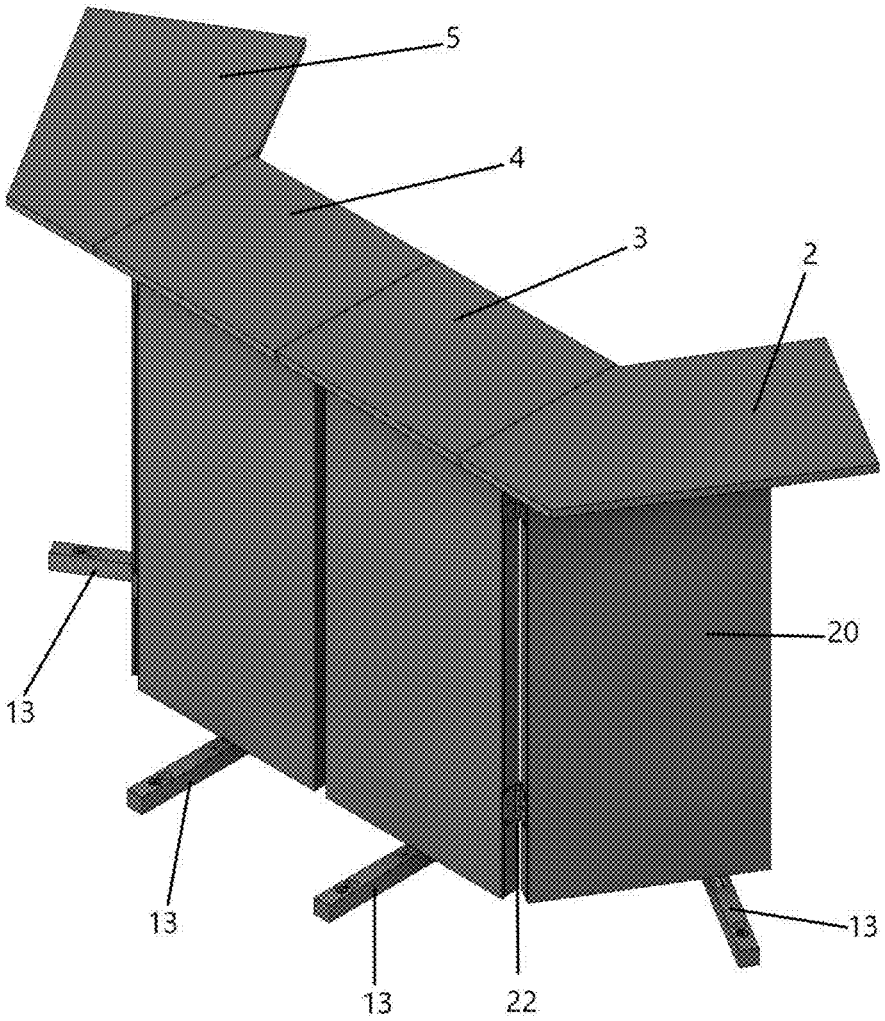
FIG. 6 is a front-right perspective view (from slightly above) of the assembled bar in the open position for use.

FIG. 2 illustrates a wood peg 47 that can be utilized to cover any counter screw or fastening holes. The purpose of the wood peg can be aesthetic (i.e. to cover screw heads) or it can be functional (i.e. to reinforce a screw and hold it in position).

The present invention defines a portable, collapsible, free-standing bar is comprised of multiple frames 20, that are interlocked by hinges 22. These hinges 22 allow for the individual frames 20 (FIG. 11) of the unit to be arranged into an open position (see FIG. 5-10) for when it is in use, or for the unit to be arranged into a closed position (see FIG. 1-4) for when it is not in use. When the bar is not in use, the closed/shut position allows for easy transport to another location and allows for space-efficiency when in storage. Each frame 20 has a bartop storage compartment on its inward-facing side. Each frame 20 also has a footing 13 at its base support 9, which can be rotated/spun out to increase the product's functional stability.

There are two positions in which the apparatus functions:

(1) The 'closed' position' which is assumed for transport and storage; and (2) The 'open/in-use position' which is assumed when the product is in use.

FIGS. 1-4 illustrate different perspectives of the bar in the closed position for transport or storage. The Portable, Collapsible, Free-Standing Bar is designed in such a way that all of its components fit into a single, compact unit when not in use. To accomplish this and to aid in the space efficiency of the apparatus, the bartop pieces 2, 3, 4, 5 can be stored inside of the frames 20 when the apparatus is not in use. Additionally, the footings 13 are designed to align perfectly with the frames 20 when the apparatus is closed and fit within the profile width of each frame 20. This positioning of the footing 13 enables each frame 20 to be flush with the others when the apparatus is closed and results in a thin/compact closed unit. One method that could be employed to hold the frames together when the apparatus is closed and to prevent the frames 20 from swinging open are frame locking magnets 21. Magnets could be aligned on each frame 20 in order to hold the frames 20 together when the apparatus is shut and allow for an easy opening process for when the apparatus is in use. One would simply need to pull apart the frames 20 when opening the apparatus for use, using some—but minimal and manageable—force to break the magnets' bonds.

FIGS. 5-10 illustrate different perspectives of the bar in the open position during use. When the apparatus is being utilized each bartop piece 2, 3, 4, 5 is connected to a top side of each corresponding frame 20. The frames 20 are designed to aid in supporting the bartop pieces 2, 3, 4, 5, but are also connected to the footings 13 at each frame's base support 9, which aids in stability.

FIGS. 13-16 illustrate first and second embodiments for attaching the footing 13 to the corresponding frame 20. Both the footing threaded bolt 43 and threaded insert 41 configuration and the threaded T-bolt 44 and T-track 45 configuration—which are alternately embedded within the footing 13—contribute to the stability of the structure, particularly when in use. Either of these embodiments can be incorporated into the footing 13 of the apparatus.

In said first embodiment (see FIG. 13-14) for attaching the footing 13, the footing 13 is connected to the frame 20 by use of a T-track 45 used in conjunction with a T-bolt 44. The T-track 45 and T-bolt 44 are attached within a bored-out space of the footing 13 and can be added to certain frames 20 (in place of the threaded bolt/insert configuration) to provide additional stability. In the pictured apparatus, the T-tracks 45 are included in the footings 13 attached to two opposite end frames 20, which allows the footings 13 to be slid out toward the outer edge of the frame. Using the T-track 45, the footings 13 can be slid to the desired location to best aid in structure support by allowing the user to create a wider base of support for the apparatus, resulting in increased stability (see FIG. 7). However, the location of the footings having the T-track 45 configuration can be manipulated as the combination and organization of frames may vary.

Alternately, in said second embodiment (see FIG. 15-16) for attaching the footing 13 to the frame 20. In said second embodiment for attaching the footing 13, the footing 13 is connected to the frame 20 by use of a threaded bolt 43 secured to a threaded insert 41, which is attached to the footing 13 and passes through a hollow hole in the base support 9. It can be tightened and held into place using a washer wingnut 46 when in use or in storage or loosened using the same washer wingnut 46 during assembly and disassembly (FIG. 16).

FIGS. 13-15 and 18-21 illustrates levelers 32 incorporated into the footings 13 to further aid in the stability of the apparatus. In addition to the aforementioned threaded bolt/threaded insert configuration of the second embodiment of the footing and T-tracks/T-bolt configuration of the first embodiment of the footing, leveler(s) 32 can also be added to the footing 13 for increased stability. The leveler(s) 32 can be installed in either, or both, ends of each footing 13. These levelers 32 run on a secured leveler threaded rod 35 and threaded insert 41 within the footing 13. During storage, they are wound up into the footing 13 by accessing the leveler head 34 with the leveler wrench key 37, but during use they can be wound down to make contact with the ground in order to level the apparatus. This is especially effective when the apparatus is used on uneven ground. This mechanism results in increased stability by ensuring contact between the apparatus' footings 13 and the ground.

The apparatus can function without the wheels 39, but when incorporated into the footings 13 of the bar, they aid in ease of transport of the apparatus. The wheels 39 are positioned at one end of each footing 13 and are placed so that they are all on the same bottom edge of the apparatus when in its closed position (see FIG. 3-4). To utilize the wheels 39 during transport of the apparatus, one would tilt the apparatus to access the wheels 39 and either push or pull the apparatus to the desired location, much like a built-in dolly. The wheels 39 are positioned within the footing 13, extending beyond a frame of the footing 13 only slightly, so as to be as undetectable as possible when in both the open and closed positions.

The footing locking system 14 is a mechanism that enables the apparatus to lock the footing 13 into position. This aids in its usability when stowed away or during transport. The footing locking system 14 is a configuration of elements that secure the footing 13 in position while the apparatus is in the closed position. The footing locking system 14 requires a bored cavity in the top of the footing 13, called the footing locking counter-bore 15. The footing locking dowel head 19 is pushed into the cavity in order to hold the footing 13 in place and prevent it from spinning on its axis while the apparatus is not in use. The footing locking dowel head 19 is attached to a bottom side of the footing locking dowel rod 18. On a top side of the footing locking dowel head 19 is the footing locking knob 17, which is manipulated by the user to either insert or remove the footing locking dowel head 19 from the footing 13, depending on whether or not the bar is in use. As mentioned above, the footing locking dowel head 19 is pushed into the bored cavity in the footing called the footing locking counter-bore 15 via manipulation, by the user, of the footing locking knob 17 when the bar is not in use. When the bar is in use, the footing locking knob 17 can be pulled upward by the user, removing the footing locking dowel head 19 from the counter-bored cavity and instead into a counter-bored cavity that is in a bottom of the base support 9 and footing locking block 16 (the latter of which is located directly on top of the base support, but does not need to run the full length of the base support). The dowel runs through both the base support 9 and the footing locking block 16, with the footing locking knob 17 resting just on top of the footing locking block 16. When the dowel head 19 is removed from the footing locking counter-bore 15 by pulling up on the footing locking knob 17, the footing 13 is free to be spun open and engaged in the open position.

In the present invention, the bartop pieces 2, 3, 4, 5 exist in two different locations/positions depending on whether the apparatus is in the open position/in-use mode or in the closed position/stow-away mode. There is more than one bartop piece 2, 3, 4, 5 for the apparatus; the exact number is dependent upon the final product desired by the user and is equal to the number of frames in the apparatus. The accompanying photos show an apparatus with four total bartop pieces 2, 3, 4, 5. Some bartop pieces 2, 3, 4, 5 may have angled edges, to allow for a curve, or turn, in the apparatus when in the open position. Angled bartop pieces—and therefore, corresponding angled frames underneath when in the open position for use—create a wider base of support for the apparatus, increasing overall stability. When in the open position, users will be able to set their objects down on the assembly bartop 1. In this open assembled position, with the frame assembly opened and base support 9 and footing 13 engaged, the user will attach the bartop pieces 2, 3, 4, 5 (via the underside connector 27) to the respective frames 20 (via the horizontal support 23). The secure method of interconnecting/attaching the frame 20 and bartop pieces 2, 3, 4, 5, effectively locking the assembled bartop 1 in place, is through the combined use of a threaded knob 42 and a threaded insert 41. The bartop pieces 2, 3, 4, 5 are secured in place by winding the threaded knob 42—which is secured into the frame 20 via the horizontal support 23—(by means of a threaded knob attached to the end of the threaded rod). The knob 42 aids in the user's grip, allowing the user to wind the threaded rod up into a threaded insert 41, which is secured into a corresponding bartop piece 2, 3, 4, 5 via the underside connector 27. Another potential method, that serves this same purpose of securing the bartop pieces 2, 3, 4, 5 to the frame 20, is a magnet activation method. A magnet switch—which is a magnet with a switch—can be used to activate and/or deactivate the magnet. Installing one of the magnets and its mate into a bartop piece (via the underside connector 27) and the frame 20 (via the horizontal support 23) would result in the bartop's securement to the frame. This method could also allow for quicker set-up.

An additional method that contributes to stability of the assembled bartop 1 and overall stability of the apparatus is the use of bartop alignment pins 6 and/or bartop edge routing 8. When properly executed, either/both can be used to aid in making the assembled bartop 1 feel as one solid unit. The alignment pins 6 serve to connect two opposing objects by one object having a pin (peg) and the other object having a corresponding alignment hole 7 to receive it. Once the alignment pin 6 is in-place, there is typically very little movement due to the tight fit of the pin in the receiving alignment hole 7.

Another possible method of building stability involves routing at least one edge 8 of each bartop piece 2, 3, 4, 5 to be flush with another adjacent bartop piece when the apparatus is in the open position (as illustrated in FIGS. 27-28). Doing so results in the bartop pieces 2, 3, 4, 5 fitting together like puzzle pieces when in use. The contours of the routed edges 8 can be paired with one another, which disperses weight pressure beyond just one bartop piece to multiple bartop pieces. This is due to the support that the routed edges create between bartop pieces.

One or multiple buckle latches 10 may also be used to add stability to the assembled bartop's 1 connection to the frame 20 as well as to the connections between adjacent bartop pieces 2, 3, 4, 5. Buckle latches 10 will be attached to an underside of the bartop pieces 2, 3, 4, 5, with one half of the buckle latch located on one bartop piece and the other corresponding half of the buckle latch located on an adjacent bartop piece. For additional stability, more than one buckle latch 10 can be used between bartop pieces.

The interior of each frame 20 has a recess defining a storage compartment for its corresponding bartop piece 2, 3, 4, 5 (see FIG. 11). When in the closed position (in transport and/or stow-away mode) each bartop piece fits and is stored in each respective compartment of the associated frame 20. The bartop pieces 2, 3, 4, 5 will be held in these storage compartments of the frames with each bartop piece 2, 3, 4, 5 has a surface inserted flatly into the corresponding frame 20, and flush with an interior of the frame panel 20A. In this position, the assembled bartop 1 rests on top of the lower horizontal support 25 and fits snuggly between the storage stopper(s) 26—which is/are attached to at least one of the vertical sidings 28—and an interior side of the corresponding frame panel 20A, preventing it from falling out of place.

To hold the bartop pieces 2, 3, 4, 5 in position vertically and prevent it from sliding up and down within the storage compartment of its corresponding frame, a cleat 12 and lace 24 tying mechanism will be utilized. The cleat 12 is affixed to the underside connector 27 of each bartop piece 2, 3, 4, 5. The lace 12, originating from the lower horizontal support 25, is used to tie a corresponding bartop piece into place by wrapping the loose end of the lace 12 around the cleat 24. (This design is similar to the tying of a boat to a dock.) Frame locking magnets 21 are used to hold the frames 20 in the closed position when the apparatus is not in use. Proper magnet poles and proper magnet placement is necessary for them to function effectively.

The frames 20 are an integral part of the apparatus as they provide connection to the footing 13 and also support and secure the assembled bartop 1 when in use. Each frame 20 functions to stabilize the overall apparatus and to secure and support the bartop pieces 2, 3, 4, 5 when in use. The frames 20 also serve to store the bartop pieces 2, 3, 4, 5 in its internal storage compartment when the apparatus is not in use. Additionally, the frame 20 is the element of the apparatus that connects—on a top end—to a bartop piece 2, 3, 4, 5 (when in use) and—on a bottom end—to the footing 13 (when in use and when not in use). Multiple frames 20 can be interconnected with hinges 22, allowing the frames to act as one unit (i.e. the 'frame assembly'). The hinges 22 allow the apparatus to be collapsed and folded up into the closed position in accordion fashion, when not in use. The hinges 22 also allow for the apparatus to be unfolded into the open position, again when in use. This method of attaching the frames allows for variability in the overall shape and size of the bar. The attached photos show an open bar with four total panels. At least one other option would be to include enough panels for a full circular, enclosed bar.

The invention claimed is:

1. A portable bar comprising:

a plurality of frames pivotally attached to each other by at least one hinge;

a bartop formed by a plurality of bartop pieces, each bartop piece corresponding with each respective frame; and a plurality of swivel footings, each footing rotatably attached to a bottom surface of a corresponding frame via either a threaded bolt or a threaded T-bolt, wherein the bar is capable of alternately being configured in an open position for using the bar and a closed position for transporting or storing the bar, wherein in the open position:

each bartop piece is selectively attached to at least one other adjacent bartop piece, each bartop piece is selectively mounted to a corresponding top surface of each respective frame, and each footing is rotated such that a length thereof is not parallel with a plane of the corresponding frame to which it is attached in order to enhance stability; and wherein in the closed position:

each bartop piece is selectively secured within a recess of each respective frame via at least one storage stopper extending from at least one surface of each respective frame, the plurality of frames collapse to a compact folded configuration forming a parallelepiped, and each footing is rotated such that a length thereof is parallel with a plane of the corresponding frame to which it is attached in order to minimize spatial requirements.

2. The portable bar according to claim 1, wherein each frame of the plurality of frames comprises:

a horizontal support connecting two vertical sidings and forming an uppermost part of said frame for selectively connecting to a bartop piece in the open position;

a base support connecting the two vertical sidings and forming a bottommost part of said frame that attaches to a respective footing; and a panel matching the cross-sectional profile formed by the horizontal support, two vertical sidings, and base support, to form a front surface of the bar in the open position.

3. The portable bar according to claim 2, wherein each frame of the plurality of frames further comprises:

a lower horizontal support above the base support and extending between the two vertical sidings;

the at least one storage stopper extending from at least one of an inner surface of one of the vertical sidings and a top surface of the lower horizontal support to secure a bartop piece in the closed position; and a lace attached to the lower horizontal support to selectively attach to a cleat of a respective bartop piece in the closed position by tying said lace to said cleat.

4. The portable bar according to claim 2, wherein the horizontal support, vertical sidings, base support, and panel of each frame of the plurality of frames are made of wood.

5. The portable bar according to claim 2, further comprising:

a foot locking system wherein each footing comprises a counter-bore for selectively receiving a selectively movable foot locking dowel rod, wherein in the closed position:

the foot locking dowel rod passes through a hole in the base support and is received in the counter-bore of the footing to effectively fix the footing to the base support and prevent rotation thereof; and wherein in the open position:

the foot locking dowel rod is removed from the counter-bore of the footing to allow for rotation of the footing relative to the base support for enhanced stability.

6. The portable bar according to claim 1, wherein each footing is rotatably attached to a bottom surface of a corresponding frame via a threaded T-bolt, and wherein each footing of the plurality of footings comprises:

a T-track along a length of each footing for receiving the T-bolt attached to a corresponding frame, wherein the T-bolt is capable of sliding within the T-track to selectively position each respective footing relative to its corresponding frame.

7. The portable bar according to claim 1, wherein each footing is rotatably attached to a bottom surface of a corresponding frame via a threaded bolt, and wherein each footing of the plurality of footings comprises:

a threaded insert for receiving the threaded bolt that passes through said footing and is rotatably secured to its corresponding frame by a washer wingnut threaded onto an end of the threaded bolt, wherein the washer wingnut moves axially along threads of the threaded bolt to tighten or loosen the attachment of said footing to its corresponding frame as desired.

8. The portable bar according to claim 1, wherein each footing of the plurality of footings comprises:

at least one leveler comprising a tip attached to an end of a threaded rod, wherein said threaded rod moves axially along threads of a threaded insert in said footing to selectively position said tip relative to a ground surface for levelling as desired.

9. The portable bar according to claim 1, wherein each footing of the plurality of footings comprises a wheel at one end thereof, wherein in the closed position:

each wheel of each corresponding footing shares an axis of rotation such that the bar can be tilted and rolled for ease of transport.

10. The portable bar according to claim 1, wherein in the open position:

each bartop piece of the plurality of bartop pieces is selectively attached to at least one other adjacent bartop piece by at least one of a buckle latch and an alignment pin to be received by a corresponding alignment hole.

11. The portable bar according to claim 1, wherein in the open position:

each bartop piece of the plurality of bartop pieces is selectively mounted to a corresponding frame by a threaded knob that passes through a horizontal support of said corresponding frame and received by a threaded insert in said bartop piece.

12. The portable bar according to claim 1, wherein in the closed position:

the plurality of frames are held in the folded configuration by at least one magnet located on each frame that magnetically attracts at least one corresponding magnet located on an adjacent frame.

13. The portable bar according to claim 1, wherein the bar is capable of alternating from the closed position to the open position without the need for tools.

14. A portable bar comprising:

a plurality of frames pivotally attached to each other by at least one hinge; and a bartop formed by a plurality of bartop pieces, each bartop piece corresponding with each respective frame;

wherein the bar is capable of alternately being configured in an open position for using the bar and a closed position for transporting or storing the bar, wherein in the open position:

each bartop piece is selectively attached to at least one other adjacent bartop piece, and each bartop piece is selectively mounted to a corresponding top surface of each respective frame; and wherein in the closed position:

each bartop piece is selectively secured within a recess of each respective frame via at least one storage stopper extending from at least one surface of each respective frame, and the plurality of frames collapse to a compact folded configuration forming a box or cuboid shape.

15. The portable bar according to claim 14, further comprising a plurality of swivel footings, each footing rotatably attached to a bottom surface of a corresponding frame via a threaded bolt, wherein each footing of the plurality of footings comprises:

a threaded insert for receiving the threaded bolt that passes through said footing and is rotatably secured to its corresponding frame by a washer wingnut threaded onto an end of the threaded bolt, wherein the washer wingnut moves axially along threads of the threaded bolt to tighten or loosen the attachment of said footing to its corresponding frame as desired, and wherein in the open position:

each footing is rotated such that a length thereof is not parallel with a plane of the corresponding frame to which it is attached in order to enhance stability; and wherein in the closed position:

each footing is rotated such that a length thereof is parallel with a plane of the corresponding frame to which it is attached in order to minimize spatial requirements.

16. The portable bar according to claim 14, further comprising a plurality of swivel footings, each footing rotatably attached to a bottom surface of a corresponding frame via a threaded T-bolt, wherein each footing of the plurality of footings comprises:

a T-track along a length of each footing for receiving the T-bolt attached to a corresponding frame, wherein the T-bolt is capable of sliding within the T-track to selectively position each respective footing relative to its corresponding frame, and wherein in the open position:

each footing is rotated such that a length thereof is not parallel with a plane of the corresponding frame to which it is attached in order to enhance stability; and wherein in the closed position:

each footing is rotated such that a length thereof is parallel with a plane of the corresponding frame to which it is attached in order to minimize spatial requirements.

* * * * *